US008201929B2

(12) United States Patent
Sugahara et al.

(10) Patent No.: US 8,201,929 B2
(45) Date of Patent: Jun. 19, 2012

(54) LIQUID JETTING APPARATUS

(75) Inventors: Hiroto Sugahara, Aichi-ken (JP); Narumi Kawai, Nagoya (JP); Yoshitsugu Morita, Nagoya (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 422 days.

(21) Appl. No.: 12/425,257

(22) Filed: Apr. 16, 2009

(65) Prior Publication Data

US 2009/0267986 A1 Oct. 29, 2009

(30) Foreign Application Priority Data

Apr. 28, 2008 (JP) ..... 2008-116954

(51) Int. Cl.

| | |
|---|---|
| ***B41J 2/175*** | (2006.01) |
| *B41J 2/17* | (2006.01) |
| *B41J 2/165* | (2006.01) |
| *B41J 2/05* | (2006.01) |
| *B05B 15/00* | (2006.01) |
| *B05C 5/00* | (2006.01) |
| *A46B 11/00* | (2006.01) |

(52) U.S. Cl. ..... 347/85; 347/66; 347/84; 347/94; 347/32; 239/76; 118/315; 401/16

(58) Field of Classification Search ..... 347/32; 239/76, 77, 140, 225.1, 450; 118/315; 401/16, 401/36

See application file for complete search history.

(56) References Cited

U.S. PATENT DOCUMENTS

| | | | | |
|---|---|---|---|---|
| 6,068,370 | A * | 5/2000 | Miller et al. | 347/85 |
| 6,123,407 | A | 9/2000 | Muraki | |
| 6,164,771 | A * | 12/2000 | Eckard et al. | 347/86 |
| 6,220,700 | B1 * | 4/2001 | Haigo | 347/85 |
| 6,422,693 | B2 * | 7/2002 | Pawlowski et al. | 347/86 |
| 6,729,706 | B1 * | 5/2004 | Patton et al. | 347/2 |
| 6,832,864 | B2 * | 12/2004 | Patton et al. | 400/323 |
| 7,399,070 | B2 | 7/2008 | Nakamura et al. | |
| 2006/0028519 | A1 * | 2/2006 | Nakamura et al. | 347/87 |
| 2006/0083564 | A1 | 4/2006 | Yazawa et al. | |
| 2006/0125873 | A1 * | 6/2006 | Nakajima | 347/32 |
| 2007/0002090 | A1 | 1/2007 | Arakawa | |
| 2007/0242100 | A1 * | 10/2007 | Takuhara et al. | 347/43 |

FOREIGN PATENT DOCUMENTS

JP S62-80076 A 4/1987

(Continued)

OTHER PUBLICATIONS

Japan Patent Office, Notice of Reasons for Rejection for Japanese Patent Application No. 2010-230289 (counterpart to above-captioned patent application), mailed Oct. 11, 2011.

(Continued)

*Primary Examiner* — Laura Martin
*Assistant Examiner* — Jeremy Bishop
(74) *Attorney, Agent, or Firm* — Baker Botts L.L.P.

(57) ABSTRACT

A plurality of ink cartridges are installed to be arranged in a vertical direction. A carriage reciprocates in the vertical direction. An ink-jet head has nozzle rows arranged, in a row in the vertical direction, to be parallel mutually, and the ink cartridge is connected to the nozzle row via a tube. There is provided a vertically long and a stylish liquid jetting apparatus which can be installed vertically even in a narrow area.

18 Claims, 14 Drawing Sheets

FOREIGN PATENT DOCUMENTS

| | | | |
|---|---|---|---|
| JP | H03-150199 | A | 6/1991 |
| JP | H05-112053 | A | 5/1993 |
| JP | H09-248916 | A | 9/1997 |
| JP | H11-277768 | A | 10/1999 |
| JP | 2002-036583 | A | 2/2002 |
| JP | 2002-362820 | A | 12/2002 |
| JP | 2003-285448 | A | 10/2003 |
| JP | 2005-262773 | A | 9/2005 |
| JP | 2005-262816 | A | 9/2005 |
| JP | 2005-288748 | A | 10/2005 |
| JP | 2005-298082 | A | 10/2005 |
| JP | 2005-335246 | A | 12/2005 |
| JP | 2006-192664 | A | 7/2006 |
| JP | 2006-205655 | A | 8/2006 |

OTHER PUBLICATIONS

United States Patent and Trademark Office, Office Action for U.S. Appl. No. 12/608,218, mailed Nov. 18, 2011.

* cited by examiner

| | |
|---|---|
| NOZZLE DIAMETER d [$\mu$m] | 30 |
| CONCENTRATION OF INK $\rho$ [g/cm$^3$] | 1.05 |
| WATER HEAD DIFFERENCE Hd [mm] | 389 |

LIQUID JETTING APPARATUS

CROSS REFERENCE TO RELATED APPLICATION

The present application claims priority from Japanese Patent Application No. 2008-116954, filed on Apr. 28, 2008, the disclosure of which is incorporated herein by reference in its entirety.

BACKGROUND OF THE INVENTION

1. Field of the Invention

The present invention relates to a liquid jetting apparatus such as a printer, which carries out printing on a recording medium.

2. Description of the Related Art

A liquid jetting apparatus which includes a liquid jetting head which jets a liquid toward a recording medium has hitherto been widely known, and as a typical example of such liquid jetting apparatus, an ink-jet printer which carries out printing on a paper by jetting an ink from an ink-jet head has been known.

Usually such liquid jetting apparatus jets a liquid while scanning the liquid jetting head in a horizontal direction, and the apparatus is installed such that the scanning direction is a horizontal direction. When such an apparatus is installed transversely, a casing (housing) of the apparatus tends to be longer in a width direction than in a height direction (vertical direction). However, it has been sought that the liquid jetting apparatus be placed vertically, or in other words, be installed in a posture such that the width of the casing is shorter than the height, as in a case of installing in line with a personal computer which is placed vertically (which is vertically long).

In Japanese Patent Application Laid-open No. 2005-262773 (FIG. 15), a liquid jetting apparatus installed vertically is shown. In this liquid jetting apparatus, a carriage 14 provided with a recording head 30 is scanned in the vertical direction (a direction of the gravitational force), and the ink cartridges 2 to 5 which supply inks to the recording head 30 are detachable from the carriage 14.

The liquid jetting apparatus as described in Japanese Patent Application Laid-open No. 2005-262773 is a so-called on-carriage type liquid jetting apparatus. Therefore, when the ink cartridge is replaced, a user have to open a lid to access to the carriage 14 from outside of the apparatus.

SUMMARY OF THE INVENTION

On the other hand, a so-called tube-supply type liquid jetting apparatus, in which an ink cartridge is installed to be fixed at a location other than a carriage and the ink cartridge is connected to an ink-jet head on the carriage via a tube, has hitherto been known. In such liquid jetting apparatus, replacement of the cartridge is easier as compared to the replacement of the cartridge in the on-carriage type liquid jetting apparatus. Consequently, if the tube-supply type is adopted to the vertically placed liquid jetting apparatus, it is possible to replace the ink cartridge easily.

The present invention is made to solve this problem, and an object of the present invention is to provide a vertically long and a stylish liquid jetting apparatus which can be installed vertically even in a narrow area.

According to the present invention, there is provided a liquid jetting apparatus which jets a plural kinds of liquids, including:

a liquid jetting head having a plurality of nozzle rows formed therein, through which the plural kinds of liquids are jetted, respectively;

a plurality of liquid tanks arranged in a vertical direction, the liquid tanks accommodating the plural kinds of liquids, respectively, to be supplied to the liquid jetting head;

a plurality of tubes which are connected to the liquid jetting head and the liquid tanks such that the nozzle rows are communicated with the liquid tanks, respectively; and a carriage which reciprocates in a predetermined range in the vertical direction while holding the liquid jetting head, wherein when the carriage is located farthest from the liquid tanks within the predetermined range, a farthest liquid tank among the liquid tanks which is located farthest from the carriage is connected to a nearest nozzle row among the nozzle rows which is located nearest from the tanks, via one tube among the tubes.

According to the present invention, in the liquid jetting apparatus which is preferable for placing vertically which is structured such that the carriage reciprocates in the vertical direction carrying the liquid jetting head thereon, since the plurality of liquid tanks for supplying the liquid to the liquid jetting head are installed in a state of being arranged in a row in the vertical direction, it is possible to suppress further a width of the liquid jetting apparatus, thereby making it possible to provide a vertically long and a stylish liquid jetting apparatus which can be installed even in a narrow area.

However, according to findings of inventors of the present invention, since the plurality of liquid tanks are installed in the state of being arranged in a row in the vertical direction, the following malfunction is a matter of concern.

In other words, in a structure in which the liquid jetting head and the liquid tank are connected with each other via a tube as in the present invention, a water head pressure between the liquid jetting head and the liquid tank acts as a pressure exerted on a meniscus which is formed in a nozzle of the liquid jetting head. Besides, when the plurality of liquid tanks are installed in the state of being arranged in a row in the vertical direction, since the water head pressure is different for each nozzle row of the liquid jetting head, the pressure acting on the meniscus also differs. For adjusting a liquid level of the plurality of tanks, manufacturing each liquid tank in a different shape may be taken into consideration. However, by doing so, a structure of the cartridge would become complicated, and a manufacturing cost of the cartridge will be high. Furthermore, when the carriage moves in the vertical direction while carrying the liquid jetting head thereon, the water head pressure of each liquid jetting head changes, and a pressure acting on the meniscus also changes. Here, when the pressure acting on the meniscus becomes high (substantial), not only there is an effect on jetting characteristics of a liquid, but also there is a possibility of the liquid getting leaked from the nozzle by the meniscus being destroyed (meniscus break). Therefore, change in the pressure acting on the meniscus is not preferable as there is a risk of that pressure becoming excessively high.

In view of this, in the present invention, a structure in which the liquid tank which is farthermost from the carriage when the carriage is positioned at the farthermost position from the plurality of liquid tanks within the predetermined range, and the nozzle row which is nearest to the plurality of liquid tanks when the carriage is positioned at the farthermost position, are made to communicate by one of the plurality of tubes, has been adopted.

Accordingly, it is possible to avoid a situation in which the water head pressure becomes the most substantial (highest) as may be assumed to be within the range of movement of the carriage, and it is possible to provide a liquid jetting apparatus in which a possibility of a leakage of a liquid due to the meniscus break is avoided, while having an effect of providing a vertically long and a stylish liquid jetting apparatus which can be placed efficiently in a narrow space as mentioned above.

According to the liquid jetting apparatus of the present invention, it is possible to provide a vertically long stylish liquid jetting apparatus which does not occupy much installation place, in which the possibility of the leakage of a liquid due to the meniscus break is reduced to a possible extent (is reduced to minimum).

DETAILED DESCRIPTION OF THE PREFERRED EMBODIMENTS

Exemplary embodiments of the present invention will be described below. The embodiments are examples in which the present invention is applied to a printer which prints an image or the like by jetting an ink onto a printing medium.

First Embodiment

Figure 1:
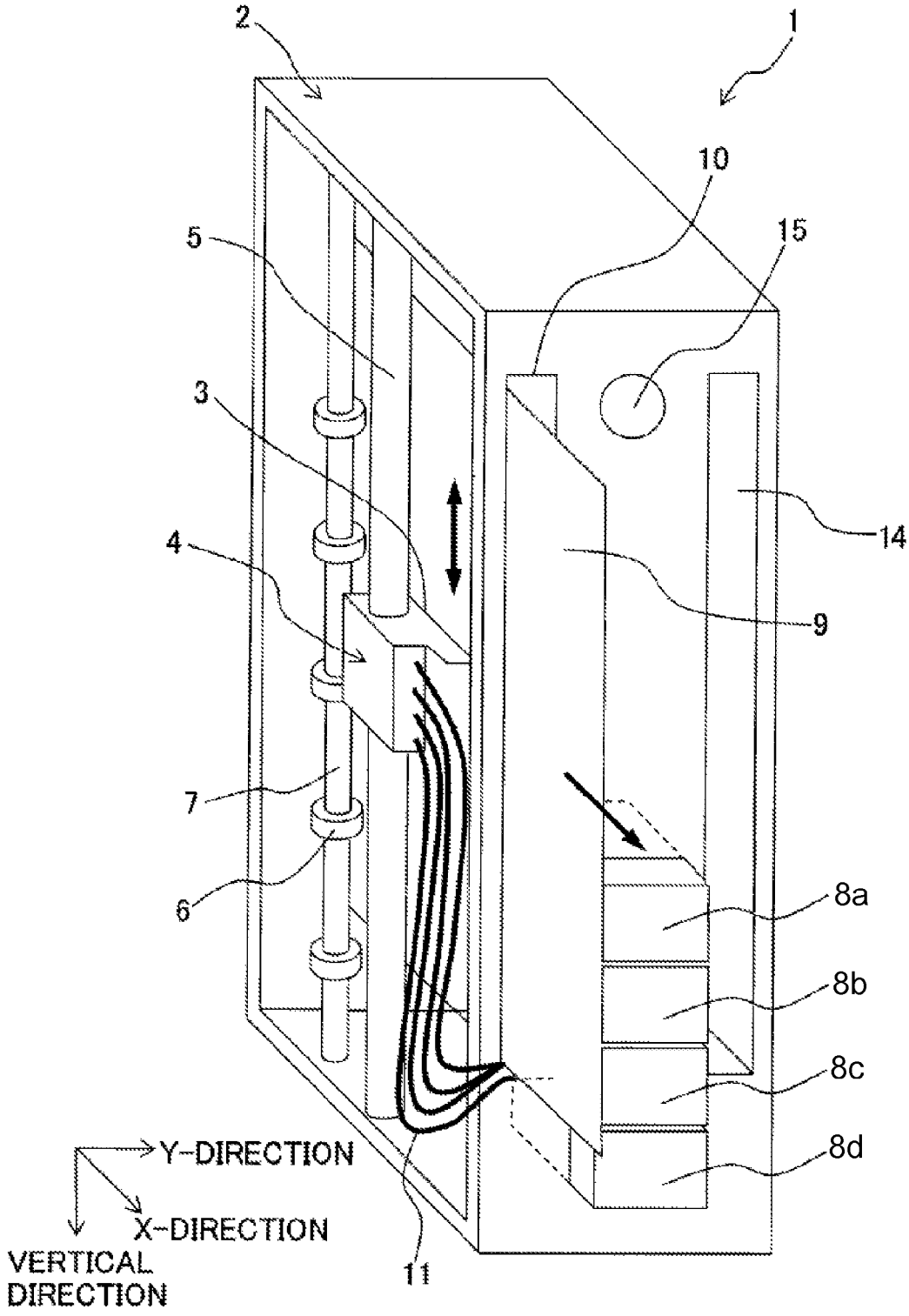
FIG. 1 is a schematic perspective view of a printer according to a first embodiment of the present invention.

FIG. 1 is a schematic structural view (a schematic perspective view) of a printer 1 according to a first embodiment of the present invention. The printer 1 has an overall shape which is longer vertically, and is a printer preferable for placing vertically (hereinafter, appropriately called as 'vertical-type printer'). As shown in FIG. 1, the printer 1 includes a body case (casing) 2, an ink-jet head 3 (liquid jetting head) which jets an ink toward a printing paper 9, a carriage 4 on which the ink-jet head 3 is mounted, a guide shaft 5 which is installed, on an inner wall of the main-body case 2, and on which the carriage 4 is slidably attached, and transporting rollers 6 having a rotating shaft 7 (rotation axis) extending in the vertical direction, which transports the printing paper 9. Moreover, a side wall of the main-body case 2 is provided with ink cartridges 8*a*, 8*b*, 8*c*, and 8*d* which store the ink, a discharge port 10 which discharges the printing paper 9 on which the printing has been performed, a paper feeding tray 14 which accommodates the printing papers 9, and a power supply switch 15. As shown in FIG. 1, in directions orthogonal to the vertical direction, a direction in which the printing paper 9 is discharged by the transporting rollers 6 from the discharge port 10 opening in the main-body case 2 is assigned to X-direction, and a direction orthogonal to X-direction as well as the vertical direction is assigned to Y-direction.

Figure 2:
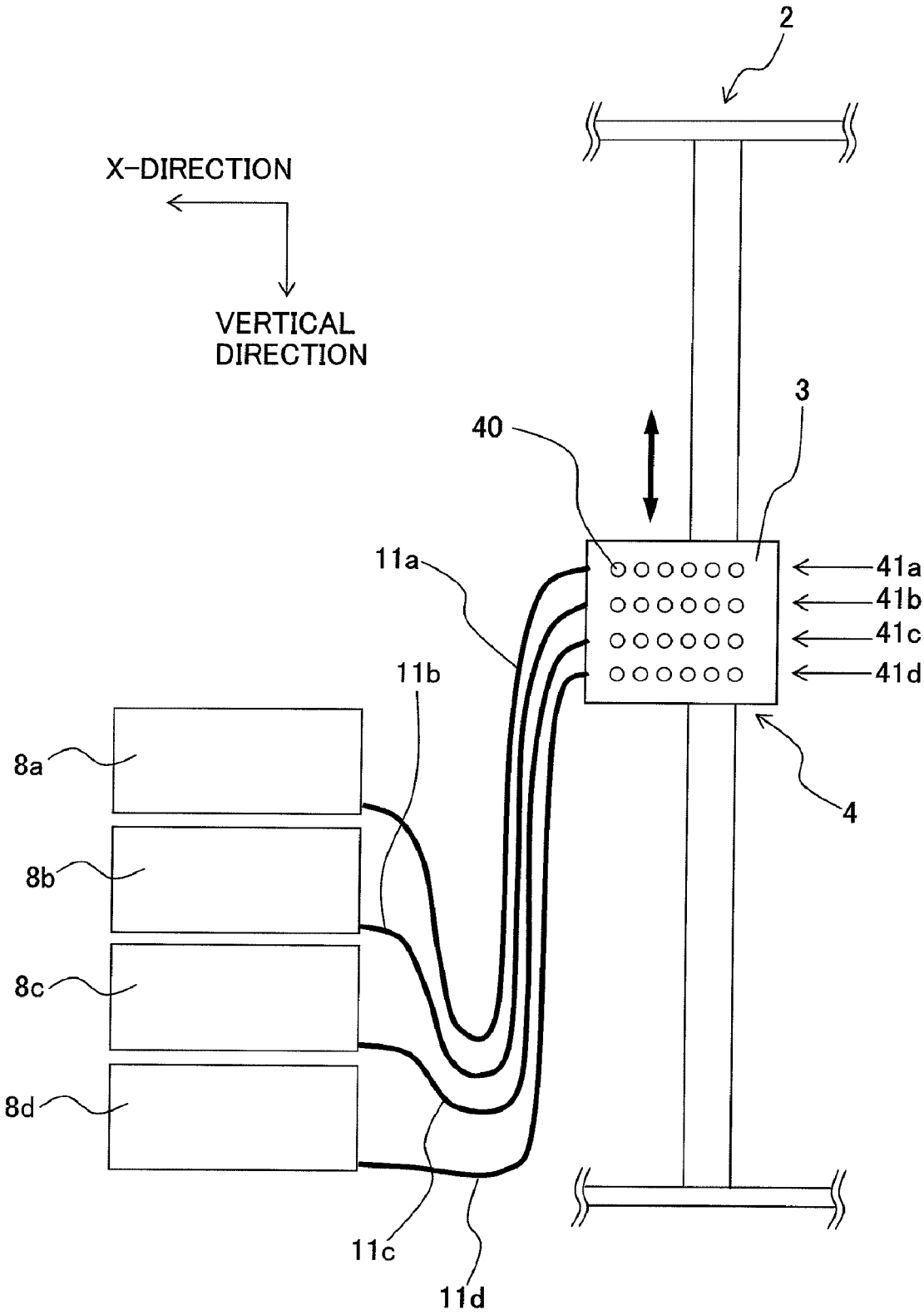
FIG. 2 is a schematic side view when the printer is viewed from Y-direction.
Figure 3:
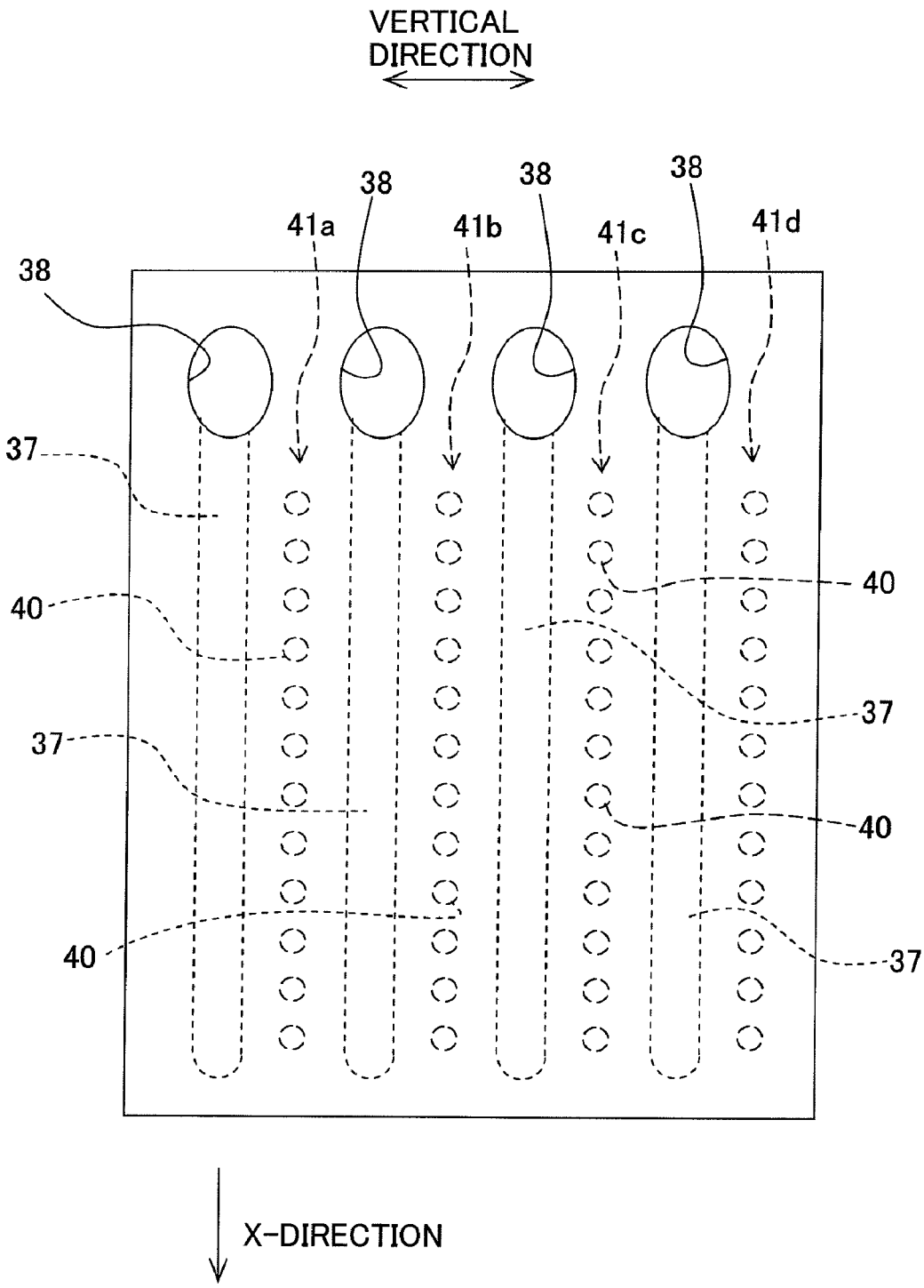
FIG. 3 is a top view of an ink-jet head.
Figure 4:
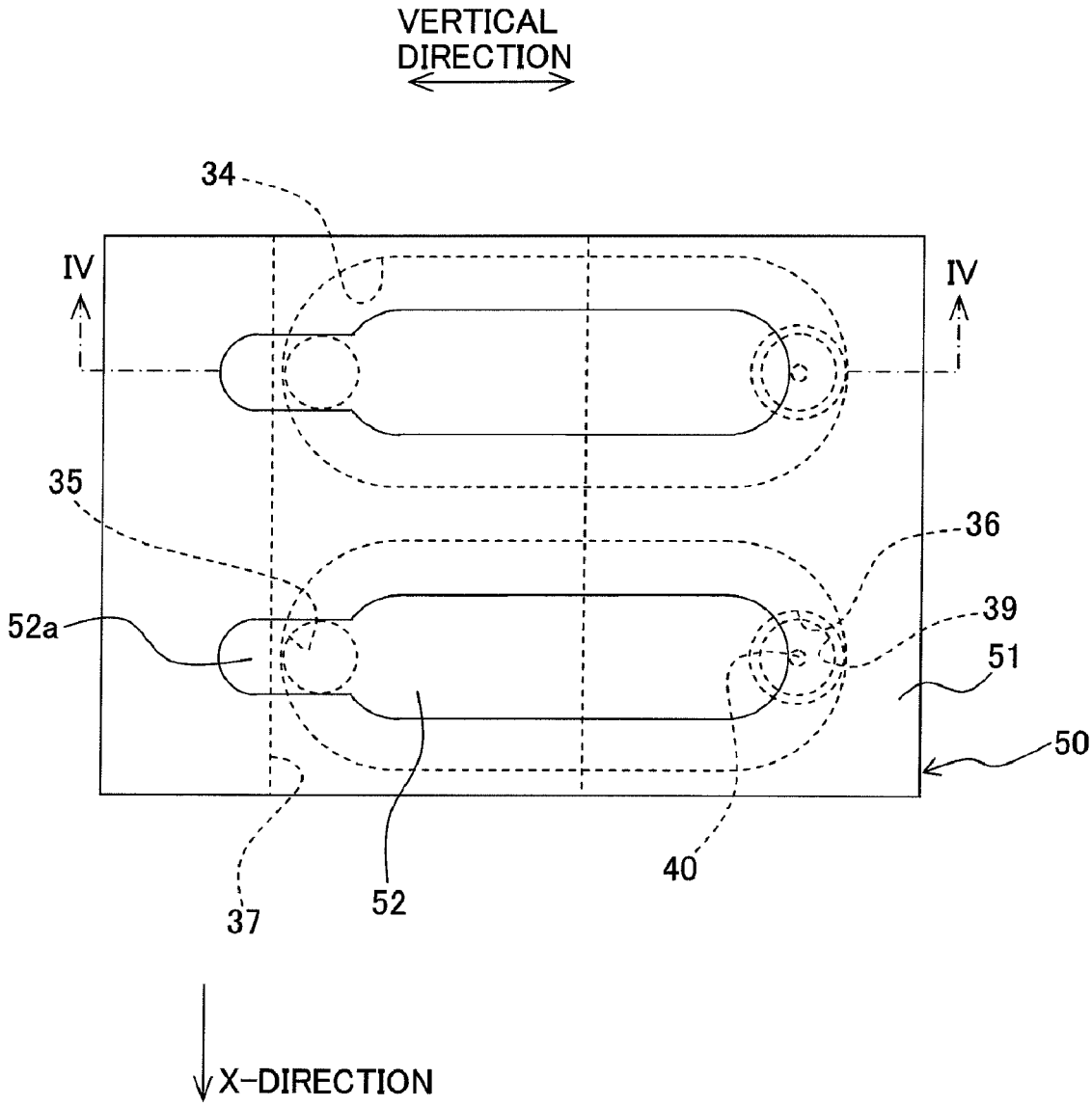
FIG. 4 is a partially enlarged view of FIG. 3.
Figure 5:
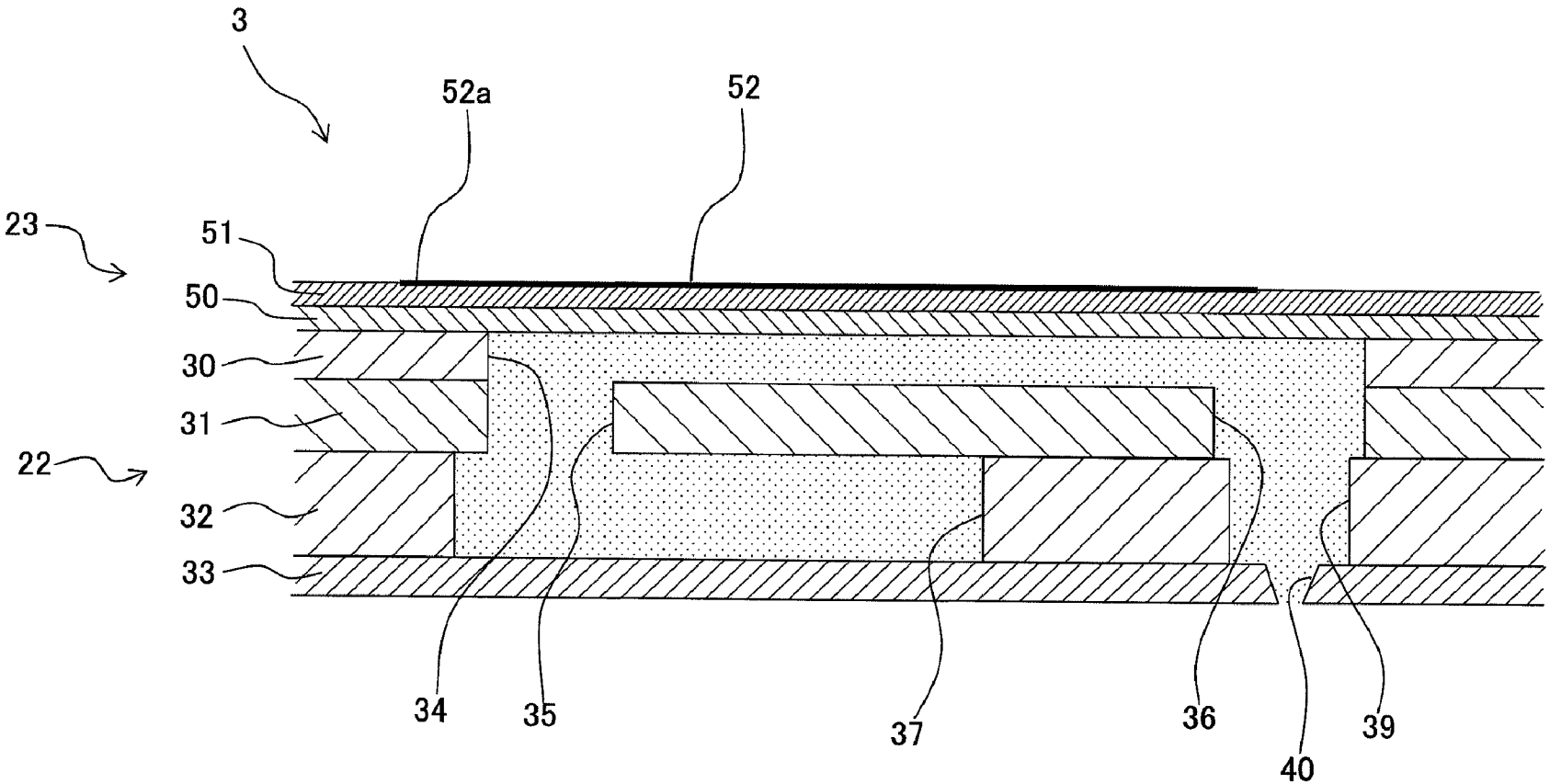
FIG. 5 is a cross-sectional view taken along a IV-IV line in FIG. 4.

The ink-jet head 3 includes a plurality of nozzles 40 (refer to FIG. 2) in an ink jetting surface facing the printing paper 9 (refer to FIGS. 3, 4, and 5). Moreover, the ink-jet head 3 is connected to the ink cartridges 8*a* to 8*d* via tubes 11 (tubes 11*a*, 11*b*, 11*c*, and 11*d* (refer to FIG. 2)), and the ink is supplied to the ink-jet head 3 from the ink cartridges 8*a* to 8*d*.

The carriage 4 is coupled with a carriage driving motor (omitted in the diagram) via a belt etc. When the carriage driving motor rotates the belt, the carriage 4 moves together with the ink-jet head 3 in the vertical direction, along the guide shaft 5.

This ink-jet head 3 jets the ink toward the printing paper 9 which is transported by the transporting rollers 6, from nozzles 40 which are provided in the ink jetting surface, while reciprocating in the vertical direction together with the carriage 4.

The transporting rollers 6 are fixed to a rotating shaft 7 which is installed between two walls, of the main-body case 2, facing with each other. When the rotating shaft 7 rotates around a rotating axis thereof, the transporting rollers 6 rotate together with the rotating shaft 7, and the printing paper 9 accommodated in the paper feeding tray 4 is transported in a paper feeding direction (X-direction). Moreover, the printing paper 9 is transported such that a surface thereof is orthogonal to Y-direction. When the printing paper 9 is transported in such manner, it is possible to make the surface of the transporting paper 9 face the nozzles 40 of the ink-jet head 3. Moreover, since the ink cartridges 8*a* to 8*d*, the discharge port 10, the paper feeding tray 14, and the power supply switch 15 are arranged on the same side surface, it is possible to carry out all operations such as power supply control, replacement of the ink cartridge, and replenishing of the printing paper 9 from the same direction. Therefore, the user can easily carry out various operations of printer.

At the time of carrying out a printing operation of the printer 1, various components such as the transporting rollers 6 and the carriage driving motor 12 are controlled by a control unit (omitted in the diagram).

Here, connection of the tubes 11 (tubes 11*a* to 11*d*) which connect the ink-jet head 3 and the ink cartridges 8*a* to 8*d* will be described below. FIG. 2 is a diagram showing the ink cartridges 8*a* to 8*d* and the ink jetting surface of the ink-jet head 3 viewed from Y-direction.

As shown in FIG. 2, the ink-jet head 3 includes four nozzle rows 41 (41*a*, 41*b*, 41*c*, and 41*d*) in each of which the plurality of nozzles 40 are arranged in a row in X-direction, and the four nozzle rows 41 (41*a* to 41*d*) are arranged to be mutually parallel, in the vertical direction. Inks of four colors namely, black, yellow, cyan, and magenta are jetted from the nozzles 40 belonging to the four nozzle rows 41*a* to 41*d* respectively. Moreover, in the first embodiment, the nozzle row 41*a* jets the black ink, the nozzle row 41*b* jets the yellow ink, the nozzle row 41*c* jets the cyan ink, and the nozzle row 41*d* jets the magenta ink.

The four ink cartridges 8*a* to 8*d* are arranged in an order of 8*a*, 8*b*, 8*c*, and 8*d* from an upper side in the vertical direction. These four ink cartridges 8*a* to 8*d* are arranged at a lower side of the main-body case 2. The black ink is stored in the ink cartridge 8*a*, the yellow ink is stored in the ink cartridge 8*b*, the cyan ink is stored in the ink cartridge 8*c*, and the magenta ink is stored in the ink cartridge 8*d*. In the first embodiment, all the ink cartridges 8*a*, 8*b*, 8*c*, and 8*d* have the same dimensions.

The printer 1 has four tubes 11*a*, 11*b*, 11*c*, and 11*d* connected to the four ink cartridges 8*a* to 8*d* respectively. The tube 11*a* communicate the nozzle row 41*a* with the ink cartridge 8*a*, the tube 11*b* communicate the nozzle row 41*b* with the ink cartridge 8*b*, the tube 11*c* communicate the nozzle row 41*c* and the ink cartridge 8*c*, and the tube 8*d* makes communicate the nozzle row 41*d* with the ink cartridge 8*d*. The ink cartridges 8*a* to 8*d*, as shown in FIGS. 1 and 2, are arranged in the main body case 2 at a lower side of an area in which the guide shaft 5 is extended. The four tubes 11*a* to 11*d* are the same type of tubes having almost same length.

Next, the ink-jet head 3 will be described below in detail. FIG. 3 is a top view of the ink-jet head 3 when viewed from Y-direction. FIG. 4 is a partially enlarged view of FIG. 3. FIG. 5 is a cross-sectional view taken along a IV-IV line in FIG. 4. However, to simplify the diagram, a pressure chamber 34 and through holes 35, 36, and 39 shown in FIG. 4 are omitted in FIG. 3, and the nozzle 40 is shown to be larger than the nozzle 40 in FIGS. 4 and 5.

As shown in FIGS. 3 to 5, the ink-jet head 3 includes a channel unit 22 in which ink channels including the nozzles 40 and the pressure chambers 34 are formed, and a piezoelectric actuator 23 which makes jet the ink from the nozzles 40 of the channel unit 22 by applying a pressure to the ink in the pressure chambers 34.

Firstly, the channel unit 22 will be described below. The channel unit 22 includes a cavity plate 30, a base plate 31, and a manifold plate 32 which are made of a metallic material such as stainless steel, and a nozzle plate 33 which is made of a insulating material (for example, a high-molecular synthetic resin material such as polyimide), and these four plates 30 to 33 are joined in a stacked state. The plurality of nozzles 40 as through holes are formed in the nozzle plate 33, and the four nozzle rows 41 as described above are arranged in the vertical direction.

As shown in FIGS. 3 and 4, the plurality of pressure chambers 34 is formed in the cavity plate 30 corresponding to the plurality of nozzles 40. Each of the pressure chambers 34 has a substantially elliptical shape which is elongated in the scanning direction, and the pressure chambers 34 are arranged such that a right-end portion of each of the pressure chambers 34 overlaps with one of the nozzles 40. Moreover, the through holes 35 and 36 are formed in the base plate 31, at positions overlapping with both-end portions in the longitudinal direction of the pressure chambers 34 in a plan view.

Four manifold channels 37 corresponding to the four nozzle rows 41*a* to 41*d* respectively are formed in the manifold plate 32. As shown in FIGS. 3 to 5, each of the manifold channels 37 is extended in the paper feeding direction at a left side of the corresponding nozzle row 41, and further, overlaps with a substantially left-half portion of the corresponding pressure chambers 34 in a plan view. Moreover, as shown in FIG. 3, end portions (end portions at an upstream side in the paper feeding direction: upper-end (of the drawing) portions in FIG. 3) of the four manifold channels 37 communicate with the four ink supply ports 38 formed in the cavity plate 30 which is at the uppermost layer. These four ink supply ports 38 are connected to the four ink cartridges 8*a* to 8*d* respectively (refer to FIG. 2), and the ink inside in the ink tanks is supplied to the manifold channel 37 through the ink supply ports 38. Moreover, the through hole 39 is formed in the manifold plate 32, at a position overlapping with both the through hole 36 in the base plate 31 and the nozzle 40 in the nozzle plate 33 in a plan view.

As shown in FIG. 5, in the channel unit 22, the manifold channels 37 communicating with the ink supply ports 38 communicates with the pressure chambers 34 via the through holes 35, and the pressure chambers 34 further communicates with the nozzles 40 via the through holes 36 and 39. In other words, a plurality of individual ink channels each ranging from an outlet (exit) of one of the manifold channel 37 to one of the nozzles 40 via one of the pressure chambers 34 is formed in the channel unit 22.

Next, the piezoelectric actuator 23 will be described below. The piezoelectric actuator 23 includes a vibration plate 50, a piezoelectric layer 51, and a plurality of individual electrodes 52. The vibration plate 50 is made of an electroconductive material such as a metallic material, and is joined to an upper surface of the cavity plate 30, to cover the plurality of pressure chambers 34. Moreover, the vibration plate 50, which is electroconductive, is connected to a ground wire of a driver IC (omitted in the diagram), and is kept at a ground electric potential all the time. Therefore, the vibration plate 50 also serves as (functions as) a common electrode for generating an electric field in a portion, of the piezoelectric layer 51, arranged between the vibration plate 50 as the common electrode and the plurality of individual electrodes, as it will be described later.

The piezoelectric layer 51 is made of a piezoelectric material which is a mixed crystal of lead titanate and lead zirconate, and is principally composed of lead zirconate titanate (PZT) which is a ferroelectric substance. The piezoelectric layer 51 is arranged continuously spreading over the plurality of pressure chambers 34 on an upper surface of the vibration plate 50. Moreover, the piezoelectric layer 51 is polarized in advance in a thickness direction thereof.

The plurality of individual electrodes 52 are provided on an upper surface of the piezoelectric layer 51, corresponding to the plurality of pressure chambers 34. Each of the individual electrodes 52 has a substantially elliptical shape in a plan view slightly smaller than the pressure chamber 34, and is arranged at a position overlapping with a substantially central portion of the pressure chamber 34 in a plan view. Moreover, one end portion (left-end portion in FIG. 4) in a longitudinal direction of each of the individual electrodes 52 is extended to left side up to a position not overlapping with one of the pressure chambers 34 in a plan view, and a front-portion of the one end portion is a contact point 52*a*. The driver IC is connected to the contact points 52*a* via a wiring member such as flexible printed circuit (FPC) which is not shown in the diagram. One of a predetermined driving electric potential and the ground electric potential is selectively applied to the plurality of individual electrodes 52 by the driver IC.

An action (operation) of the piezoelectric actuator 23 having the abovementioned structure will be described below. When a pressure is not applied to the ink (when ink is not jetted from the nozzles 40), an electric potential of the plurality of individual electrodes 52 is kept at the ground electric potential in advance. When the predetermined electric potential is applied to one of the plurality of individual electrodes 52 by the driver IC, an electric potential difference is generated between the individual electrode 52 to which the driving electric potential is applied and the vibration plate 50 as the common electrode which is kept at the ground electric potential, and an electric field in the thickness direction of the piezoelectric layer 51 is generated in a portion of the piezoelectric layer 51 sandwiched between the individual electrode 52 and the vibration plate 50. Here, when the polarization direction of the piezoelectric layer 51 is same as the direction of the electric field, the piezoelectric layer 51 elongates in the thickness direction thereof, and contracts in an in-plane direction thereof. With a contraction deformation of the piezoelectric layer 51, a portion of the vibration plate 50 facing the pressure chamber 34 is deformed to form a projection toward the pressure chamber 34 (unimorph deformation). In this actuator unit 25, a stand-by state in which the vibration plate 50 is deformed as described above is assumed till a jetting of the ink. At the time of jetting the ink, the driver IC stops applying the driving electric potential to the individual electrode 52. Accordingly, the electric potential of the individual electrode 52 becomes the ground electric potential, and the vibration plate 50 returns to (regains) the original form. Consequently, there is an increase in a volume of the pressure chamber 34 compared to the volume of the pressure chamber 34 during the stand-by state, and a pressure wave is generated in the pressure chamber 34. Here, as it has hitherto been known, when a time taken by the pressure wave 34 generated due to the increase in the volume of the pressure chamber 34, for one-way propagation in a longitudinal direction of the pressure chamber 34 has elapsed, a negative pressure inside the pressure chamber 34 changes to a positive pressure. At a timing at which the pressure inside the pressure chamber 34 changes to the positive pressure, the driver IC applies the driving electric potential once again to the individual electrode 52. At this time, since the previous pressure wave generated due to the increase in the volume of the pressure chamber 34 described above is combined with a current pressure wave which is generated when the vibration plate 50 is deformed to form a projection toward the pressure chamber 34, a substantial pressure is applied to the ink inside the pressure chamber 34, and the ink is jetted from the nozzle 40.

At the time of printing in the first embodiment, the ink-jet head 3 carries out printing by jetting the ink while moving in the vertical direction for each pitch. Therefore, the ink-jet head 3 comes closer to and goes away from the cartridges 8*a* to 8*d*.

Here, a positional relationship between the ink-jet head 3 and the ink cartridges 8*a* to 8*d* will be described below with reference to FIG. 6.

Figure 6:
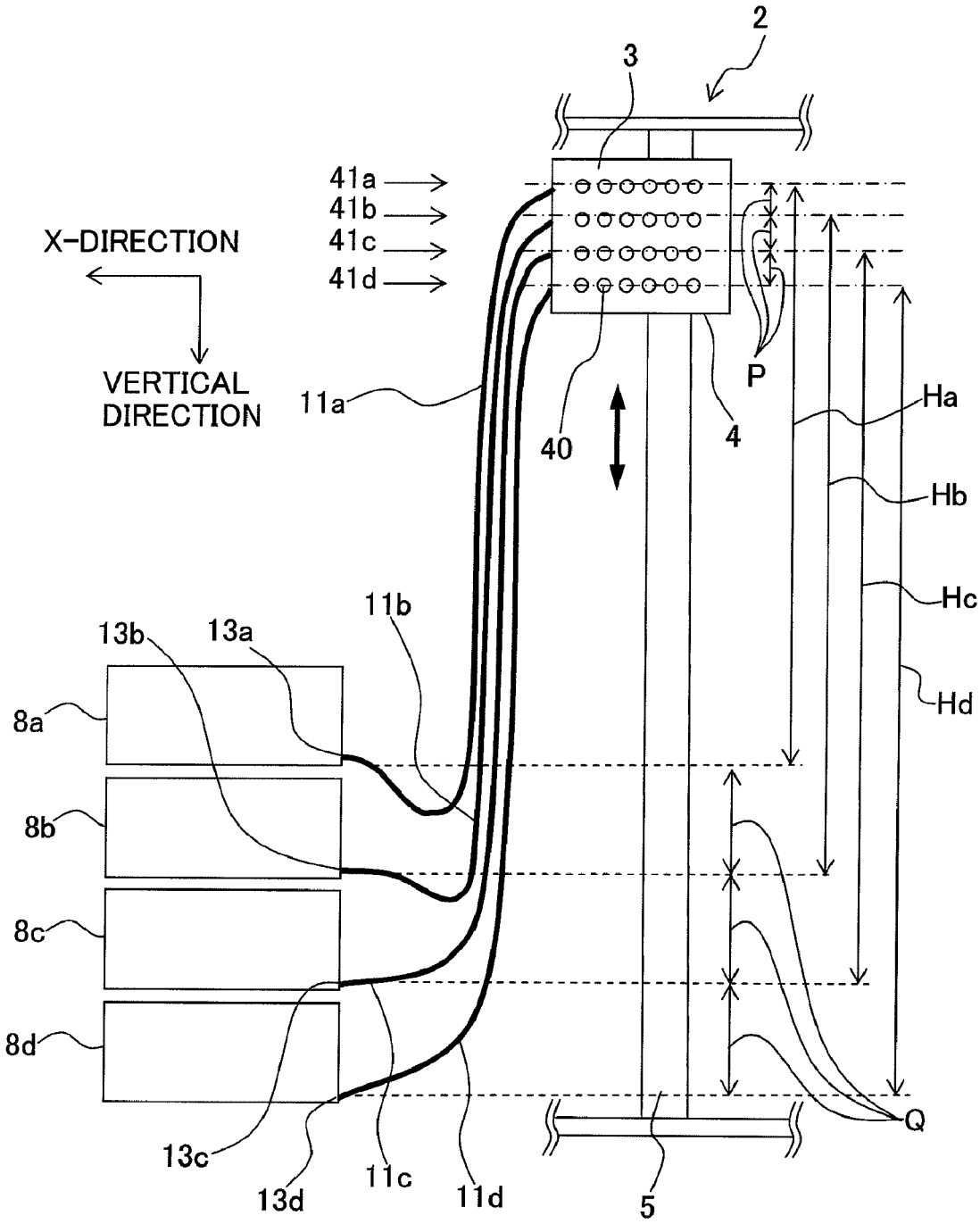
FIG. 6 is a side view when the ink-jet head is positioned at an uppermost end of a guide shaft.

As shown in FIG. 6, when the ink-jet head 3 is positioned at an uppermost end (farthermost position) of the guide shaft 5, the ink-jet head 3 is located farthest from the ink cartridges 8*a* to 8*d*. Incidentally, in a tube-supply type ink-jet printer such as the printer 1 according to the first embodiment, the nozzles 40 are exposed to the ambient air all the time, and an interior of the ink cartridge is also maintained at an ambient pressure (an atmospheric pressure) by fine holes being provided in the ink cartridge. Therefore, when the ink-jet head 3 is positioned at an upper side of the ink cartridges 8*a* to 8*d*, a hydraulic pressure (a water pressure) which pulls (sucks) the ink inside the nozzle 40 toward the cartridges 8*a* to 8*d* is generated due to a water head difference between the liquid level in the nozzle 40 and a liquid level of the ink inside the ink cartridges 8*a* to 8*d*, and the air is sucked from the nozzle 40. Therefore, there is a possibility that the jetting characteristics of the ink are affected substantially by the air entering into the nozzle 40.

Moreover, in the ink-jet head 3 according to the first embodiment, an interval (a distance) P between the nozzle rows 41*a* to 41*d* is narrowed for a size reduction of the ink-jet head 3. Whereas, the ink cartridges 8*a* to 8*d* have a size which is enough for securing a sufficient amount of ink stored. Furthermore, communication ports 13*a*, 13*b*, 13*c*, and 13*d* of the tubes 11*a* to 11*d* respectively are arranged on a lower side of the ink cartridges 8*a* to 8*d*. Therefore, the interval P between the nozzle rows 41*a* to 41*d* is smaller than an interval Q between the communication ports 13*a* to 13*d*.

Accordingly, when the ink-jet head 3 is positioned at the uppermost end, the water head difference Ha between the nozzle row 41*a* and ink cartridge 8*a* is minimum. Then, the nozzle row 41*b* approaches to the ink cartridge 8*b* by a distance equivalent to the interval P with respect to the nozzle row 41*a*, and the ink cartridge 8*b* goes away from the ink-jet head 3 by a distance equivalent to the interval Q, with respect to the ink cartridge 8*a*. Moreover, since the interval Q is longer than the interval P, as a result, a water head difference Hb between the nozzle row 41*b* and the ink cartridge 8*b* is larger than the water head difference Ha by an amount equivalent to Q-P. Similarly, a water head difference Hc between the nozzle row 41*c* and the ink cartridge 8*c* is larger than the water head difference Hb, and a water head difference Hd between the nozzle row 41*d* and the ink cartridge 8*d* is larger than the water head difference Hc. Therefore, the water head differences Ha, Hb, Hc and Hd are large in this order. With a consumption of ink in the ink cartridge, a height of the ink (liquid) level fluctuates. However, each of the water head differences becomes maximum when the ink level inside the ink cartridge is positioned near a bottom surface of the ink cartridge. Therefore, FIG. 6 indicates a case in which Ha, Hb, Hc, and Hd are the maximum water head differences.

In this manner, since the water head differences between the ink cartridges 8*a* to 8*d* and the communication ports 13*a* to 13*d* are different from each other, a hydraulic pressure acting on the ink in the nozzles 40 of the respective nozzle row 41 also differs.

Since the ink cartridge 8*d*, which is located farthest from the ink-jet head 3 when the ink-jet head 3 is positioned at the uppermost end, is not connected to the nozzle row 41*a* but is connected to the ink supply port 38*d* which is connected to the nozzle row 41*d*, it is possible to avoid a maximum water head difference at that position, and it is possible to realize a minimum water head difference regarding the ink cartridge 8*d*.

Moreover, the ink cartridge 8*c* is not connected to the ink supply port 38*d* of the nozzle row 41*d*, which causes a minimum water head difference when the ink-jet head 3 is positioned at the uppermost end, but is connected to the ink supply port 38 of the nozzle row 41*c* which is at a positional relationship of a distance closer next to the nozzle row 41*d*. Moreover, the ink cartridge 8*b* is connected to the ink supply port 38*b* of the nozzle row 41*b*, and the ink cartridge 8*a* is connected to the ink supply port 38*a* of the nozzle row 41*a*. In this manner, it is possible to select the combination between the ink cartridges 8*a* to 8*d* and the nozzle rows 41*a* to 41*d* so as to avoid a situation in which the water head difference becomes extremely high (substantial).

As shown in FIG. 6, a range between the uppermost end and the lowermost end of the guide shaft 5 between which the carriage 4 is movable corresponds to a 'range of movement (movable range)' of the carriage.

If the ink cartridges 8*a* to 8*d* are not connected to the nozzle rows 41*a* to 41*d*, respectively, in this order as described above, a water head pressure of a certain ink cartridge may be extremely high whereas another water head pressure of another ink cartridge may be extremely low. In such a case, since there is a substantial difference in the water head pressures of the ink cartridges, it becomes necessary to change a driving electric potential for making the ink jetting characteristics of the nozzle rows uniform. Accordingly, since it becomes necessary to provide a power supply of plurality of voltages, there is a possibility of an increase in a cost.

Consequently, the nozzle rows 41*a* to 41*d* are connected to the ink cartridges 8*a* to 8*d*, respectively, based on the alignment sequences of both of the nozzle rows 41*a* to 41*d* and the ink cartridges 8*a* to 8*d*, as described above. In this case, when the jetting characteristics of the ink is corrected to be uniform, it is possible to suppress an amount of change in the driving electric potential. Therefore, it is not necessary to carry out a design change due to an increase in an amount of voltage, and a selection of material, and it is possible to suppress the cost.

Furthermore, since the nozzle rows 41*a* to 41*d* are arranged in the vertical direction such that the nozzle rows 41*a* to 41*d* are mutually parallel, it is possible to make uniform the interval Q with the adjacent nozzle row 41 (41*a* to 41*d*). Therefore, for the plurality of nozzles 40 in the adjacent nozzle rows 41 (41*a* to 4*d*) it is possible to make uniform a difference of the water head pressure between each of nozzles 40 and the nozzle 40 lined to be adjacent in the vertical direction.

Moreover, the interval Q of the communication ports 11*a* to 11*d* of the cartridges 8*a* to 8*d* is not to be made small in accordance with the interval P of the nozzle rows 41*a* to 41*d*, and may be made larger than the interval P of the nozzle rows 41*a* to 41*d*. Therefore, even when the nozzle rows 41*a* to 41*d* are arranged densely in a small space for the size reduction of the ink-jet head 3, it is possible to make an arrangement such that a volume of the ink cartridges 8*a* to 8*d* is secured sufficiently. Accordingly, it is possible to realize both the size reduction of the ink-jet head 3 and a volume increase of the ink cartridges 8*a* to 8*d*. Moreover, since the ink cartridges 8*a* to 8*d* are arranged in a row in the vertical direction, it is possible to suppress further a width of the printer 1. Furthermore, since the nozzle rows 41*a* to 41*d* and the ink cartridges 8*a* to 8*d* are arranged in the same alignment sequence, it is possible to avoid a situation in which, for the ink-jet head 3, the water head pressure becomes maximum (most substantial) as may be assumed to be within the range of movement of the carriage 4. Based on the description made above, it is possible to provide the printer 1 in which a possibility of leakage of an ink due to the meniscus break is avoided, while having an effect of providing a vertically long and a stylish liquid jetting apparatus which does not occupy much space for installation.

Second Embodiment

Figure 12:
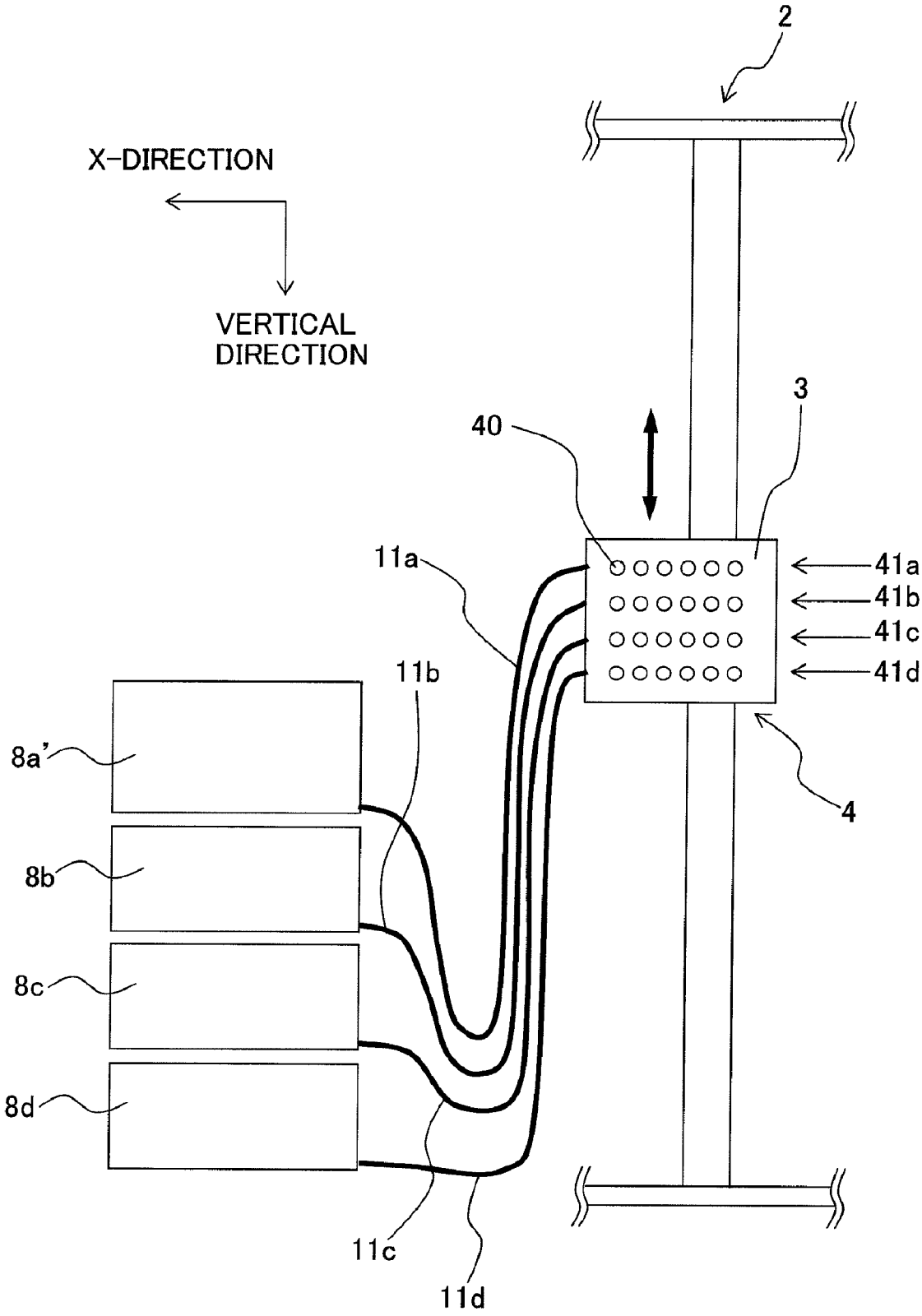
FIG. 12 is a schematic side view of a printer according to a second embodiment of the present invention.

As shown in FIG. 12, the printer 1 according to a second embodiment is manufactured similarly as the printer 1 according to the first embodiment except for a point that, a height (thickness in the vertical direction) of the ink cartridge 8*a*' is more than a height of the other ink cartridges 8*b*, 8*c*, and 8*d*. In an ink-jet printer which jets inks of different colors, in a case in which an ink of a specific color such as a black ink is to be consumed more than the inks of the other colors, it is possible to make large an ink cartridge for such ink of a specific color. When a height of the specific ink cartridge is more than a height of the other ink cartridges, an amount of fluctuation (an amount of change) in the liquid level of the ink inside the cartridge with the consumption of the ink becomes more substantial. Accordingly, when such ink cartridge of a substantial height is mounted in a vertical printer, the water head pressure of the nozzle and the cartridge fluctuates more substantially with the consumption of the ink. When such ink cartridge with substantial fluctuation in the water head pressure is arranged at a lower side in the vertical direction of the printer, since the water head difference becomes substantial, the meniscus becomes more unstable. Accordingly, in a case of using the ink cartridges of different heights in a vertical printer, the ink cartridge 8*a*', which may cause the maximum fluctuation in the water head pressure due to the consumption of ink, is arranged at a highest position (position nearest to the carriage when the carriage is positioned at the farthermost position from the plurality of ink cartridges within the predetermined range of movement of the carriage). Then, it is possible to maintain the meniscus of the ink in the nozzle communicating with the ink cartridge 8*a*' to be more stable.

Third Embodiment

Figure 13:
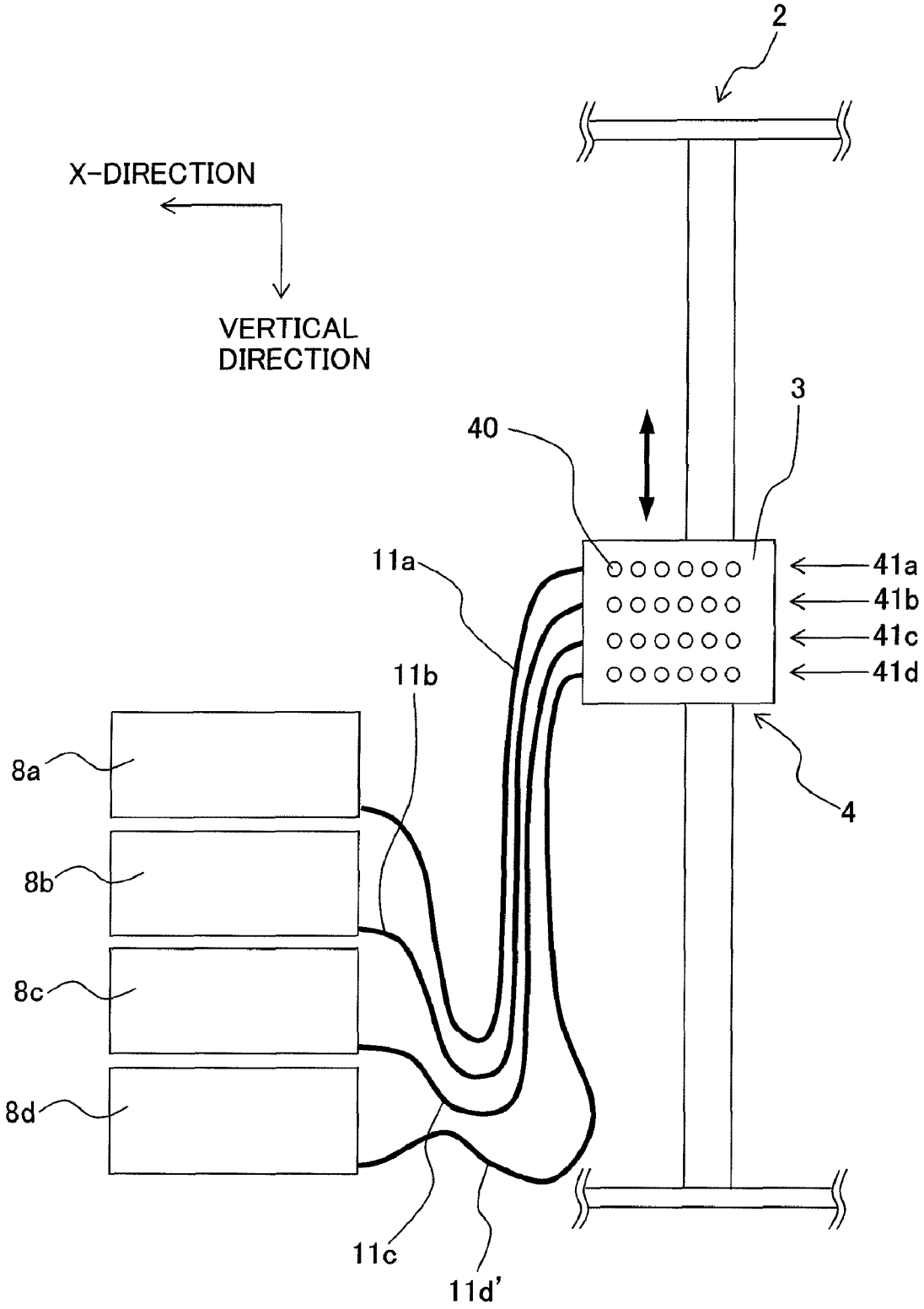
FIG. 13 is a schematic side view of a printer according to a third embodiment of the present invention.

As shown in FIG. 13, the printer 1 according to a third embodiment is manufactured similarly as the printer 1 according to the first embodiment except for a point that, a tube 11*d*' which is to be connected to the ink cartridge 8*d* is made to be longer by approximately 10% than the tubes 11*a*, 11*b*, and 11*c* which are to be connected to the other ink cartridges 8*a*, 8*b*, and 8*c*, respectively, and an inner diameter of the tube 11*d*' is made to be smaller by about 10% than an inner diameter of the other tubes 11*a*, 11*b*, and 11*c*. Then a flow resistance of the ink flowing through the tube 11*d*' becomes higher than a flow resistance of the ink flowing through the other tubes 11*a*, 11*b*, and 11*c*. Accordingly, even when the water head difference between the nozzle row 41*d* and the ink cartridge 8*d* which are connected by the tube 11*d*' according to a position in the vertical direction of the ink-jet head 3, since the flow resistance of the ink from the ink-jet head 3 to the ink cartridge 8*d* is substantial as compared to the flow resistance of the ink flowing through the other tubes, either a speed of propagation of such water head difference to the nozzle row 41*d* becomes slow, or the water head difference is reduced. Accordingly, it is possible to reduce an action of the water head pressure directly on the meniscus in the nozzle of the nozzle row 41*d*. Particularly, when the carriage reciprocates in the vertical direction at a high speed (high velocity), the water head difference fluctuates temporally in accordance with a position of movement (a moving position). However, this fluctuation is reduced by the flow resistance of the ink in the ink tube, and it is possible to make small the fluctuation (variation) in the water head pressure from a maximum value to a minimum value.

Since a channel resistance becomes high when the length of the tube is increased, the tube 11*d*' may be longer by more than 10% than the other tubes 11*a*, 11*b*, and 11*c*. In the third embodiment, the length of the tube 11*d*' is longer than the length of the other tubes, and the inner diameter of the tube 11*d*' is smaller than the inner diameter of the other tubes. However, the length of the tube 11*d*' may be be longer than the length of the other tubes, and the inner diameter of the tube 11*d*' may be the same as the inner diameter of the other tubes. Or, the length of the tube 11*d*' may be almost the same as the length of the other tubes, and the inner diameter of the tube 11*d*' may be smaller than the inner diameter of the other tubes.

According to the third embodiment, as compared to the first embodiment, it is possible to maintain the meniscus of the nozzle more favorably by reducing substantially an effect of the water head difference in the vertical printer.

Fourth Embodiment

Figure 14:
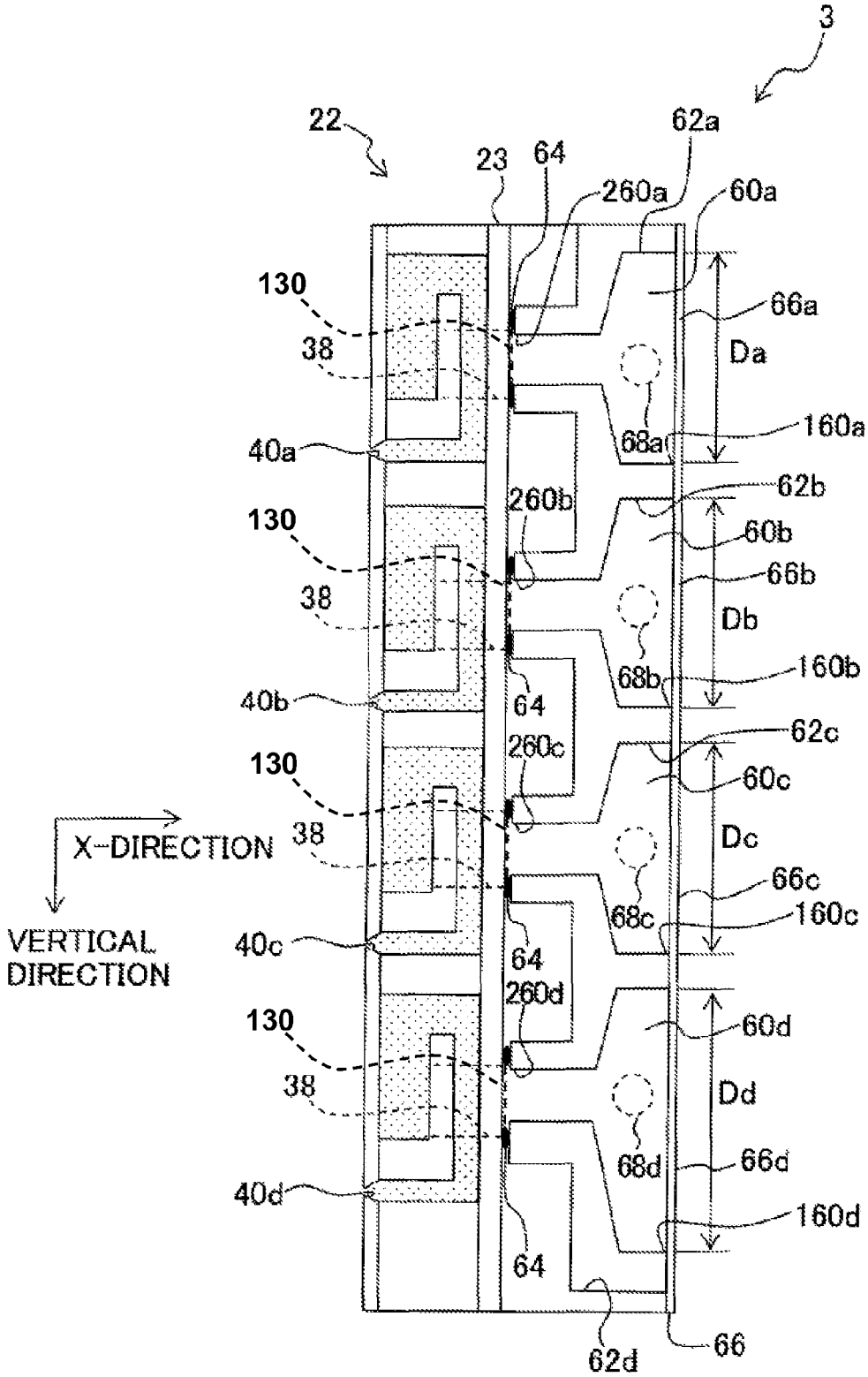
FIG. 14 is a cross-sectional view of an ink-jet head of a printer according to a fourth embodiment of the present invention.

In a fourth embodiment, in addition to the specific order of connection of the ink cartridges 8*a* to 8*d* and the nozzles 41*a* to 41*d* as described in the first embodiment, a modification is carried out in the ink-jet head, thereby reducing substantially the effect of the water head difference in the nozzle row 41*d* communicating with the ink cartridge 8*d*. In FIG. 14, a schematic cross-sectional view when the ink jet head 3 is viewed from X-direction is shown. Nozzles corresponding to the four nozzle rows 41*a* to 41*d* are denoted by reference numerals 40*a*, 40*b*, 40*c*, and 40*d*, respectively (hereinafter, 'nozzles 40*a* to 40*d*'). A jetting unit of each nozzle of the ink jet head 3 has a structure as shown in FIG. 5, and includes the channel unit 22 and the piezoelectric actuator 23 as described above. Holders 62*a*, 62*b*, 62*c*, and 62*d* in which buffer tanks 60*a*, 60*b*, 60*c*, and 60*d* are formed therein are provided to the piezoelectric actuator 23, on an opposite side of the channel unit 22. Large openings 160*a*, 160*b*, 160*c*, and 160*d* and small openings 260*a*, 260*b*, 260*c*, and 260*d* are formed at the both ends of the buffer tanks 60*a* to 60*d*, respectively. The small openings 260*a* to 260*d* of the buffer tanks 60*a* to 60*d* are connected to the ink supply ports 38 communicating with the pressure chamber 34 of the channel unit 22, and a filter 130 is installed at each ink supply port 38. Communicating holes 68*a*, 68*b*, 68*c*, and 68*d* which are connected to the ink tubes 8*a* to 8*d* are formed in a wall surface (rear surface) of the buffer tanks 60*a* to 60*d*. The large openings 160*a* to 160*d* of the buffer tanks 60*a* to 60*d* are closed (sealed) by a film 66 which covers the holders 62*a* to 62*d*.

A portions of the film 66 covering the large openings 160*a* to 160*d* respectively, function as dampers 66*a*, 66*b*, 66*c*, and 66*d*. The dampers 66*a* to 66*d* attenuate a pressure wave in the ink which is generated by the action of the piezoelectric actuator 23 and propagated from the pressure chamber 34 of the channel unit 22. Accordingly, the pressure wave is prevented from being propagated to the nozzle. The film 66 is formed of polyimide which is elastic material. In the invention of the fourth embodiment, a fluctuation of the water head pressure due to the ink cartridges or the ink cartridges is prevented effectively by using the dampers 66*a* to 66*d*. According to a size (an area) of the dampers (film), it is possible to adjust the damping force of the pressure wave in the ink. In the ink-jet head according to the fourth embodiment, an inner diameter Dd of the large opening 160*d* of the buffer tank 60*d* is more than inner diameters Da, Db, and Dc of the large openings 160*a* to 160*c* of the buffer thanks 60*a* to 60*c* respectively. Therefore, a portion of the film 66 sealing the large opening 160*d*, that is, the damper 66*d* has a damping force stronger (higher) than a damping force of the dampers 66*a* to 66*c* covering the large openings 160*a* to 160*c*. When the ink-jet head 3 moves with respect to the ink cartridges 8*a* to 8*d*, the water head difference between the ink cartridge and the corresponding nozzle row fluctuates accordingly. In other words, the water head difference fluctuates in relation to a position of the ink jet head or a frequency of time of movement, and is propagated to the nozzle row (or the ink cartridge) as a pressure wave. Moreover, when the ink-jet head 3 is positioned at a position shown in FIG. 6, each of the water head difference Ha to Hd becomes maximum (among the water head difference Ha to Hd, the water head difference Hd is maximum). Even when there occurs a change in the water head difference due to the movement of the ink-jet head, it is possible to absorb the pressure wave generated by this change in the water head difference by the damper 66*d* which communicates with the nozzle row 41*d*. Particularly, since the damping force of the damper 66*d* is stronger as compared to the damping force of the other dampers 66*a* to 66*c*, it is possible to attenuate or delay the pressure wave in the ink, which is the change in the water head difference, even more effectively, and to prevent or delay the propagation of the pressure wave to the nozzle row.

In the fourth embodiment, the diameter of the damper 66*d* is larger (an area of the damper 66*d* is larger) than that of the other dampers 66*a* to 66*c*. However, a thickness of the film 66 may be more (may be increased) only for the damper 66*d*. Or, only the damper 66*d* may be formed of other film material such that the damping force of the damper 66*d* is stronger (higher) as compared to the damping force of the other dampers 66*a* to 66*c*.

Next, modified embodiments in which, various modifications are made in the embodiments described above will be described below. However, same reference numerals are assigned to components which have a similar structure as in the embodiments described above, and the description of such components is omitted appropriately.

First Modified Embodiment

As inks to be stored in the ink cartridges 8*a* to 8*d*, inks having a content of a surfactant (surface active agent) changed may be used.

In this case, inks in which the content of the surfactant is increased for the cartridges in order of 8*a* to 8*b*, 8*c*, and 8*d* are used.

Here, as a surfactant in the first modified embodiment, an acetylenic glycol-based surfactant or an acetylenic alcohol-based surfactant is used. It has been widely known that when the content of these surfactants in a solvent increases, there is a decline in a surface tension.

Therefore, to avoid an effect on the jetting characteristics of the ink while preventing the breaking of the meniscus, based on a difference in a magnitude of the water head pressure which acts on the meniscus in the nozzles of the nozzle rows 41*a* to 41*d*, an arrangement is made such that the surface tension becomes substantial (increases) in the order of the ink cartridges 8*a* to 8*b*, 8*c*, and 8*d*, for the ink stored in the ink cartridges 8*a* to 8*d* for having a well-balanced surface tension relationship.

Accordingly, in a printer in which the ink cartridges 8*a* to 8*d* are arranged in the vertical direction, as shown in FIG. 6, even when the ink-jet head 3 is positioned at the uppermost end of the guide shaft 5, it is possible to reduce a possibility of occurrence of the meniscus break, even for the combination of the nozzle row 41*d* and the ink cartridge 8*d* located at the farthest distance from the ink-jet head 3, the combination being a combination in which the meniscus break occurs most susceptibly.

Here, the surface tension acting on the nozzle 40 which is related to the meniscus break that may occur in the nozzle 40, and the water head pressure which is generated according to the positional relationship between the nozzle and the ink cartridge will be described below.

Figure 7:
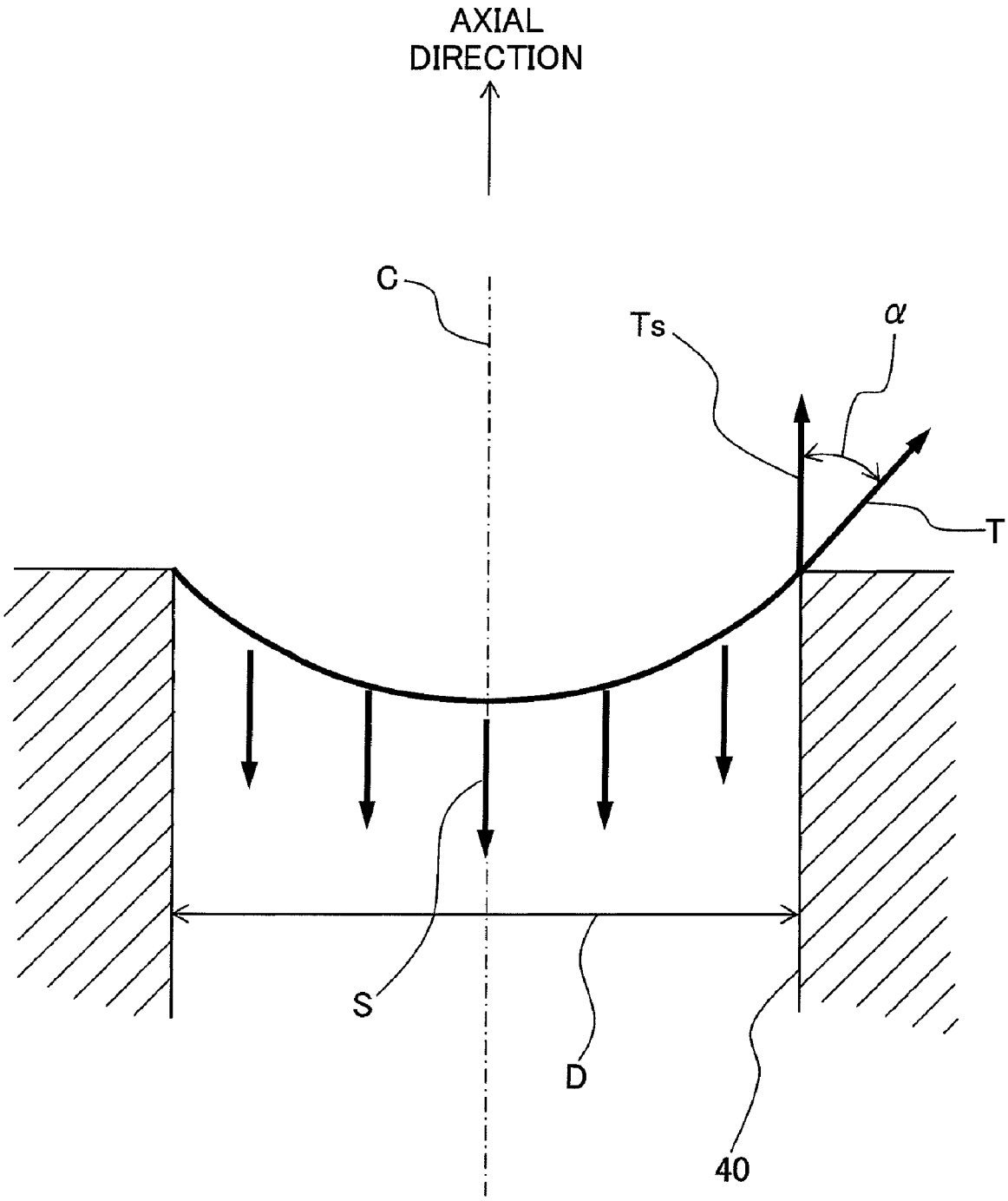
FIG. 7 is diagram showing a pressure which acts on a meniscus at an opening of a nozzle.
Figures 8, 9:
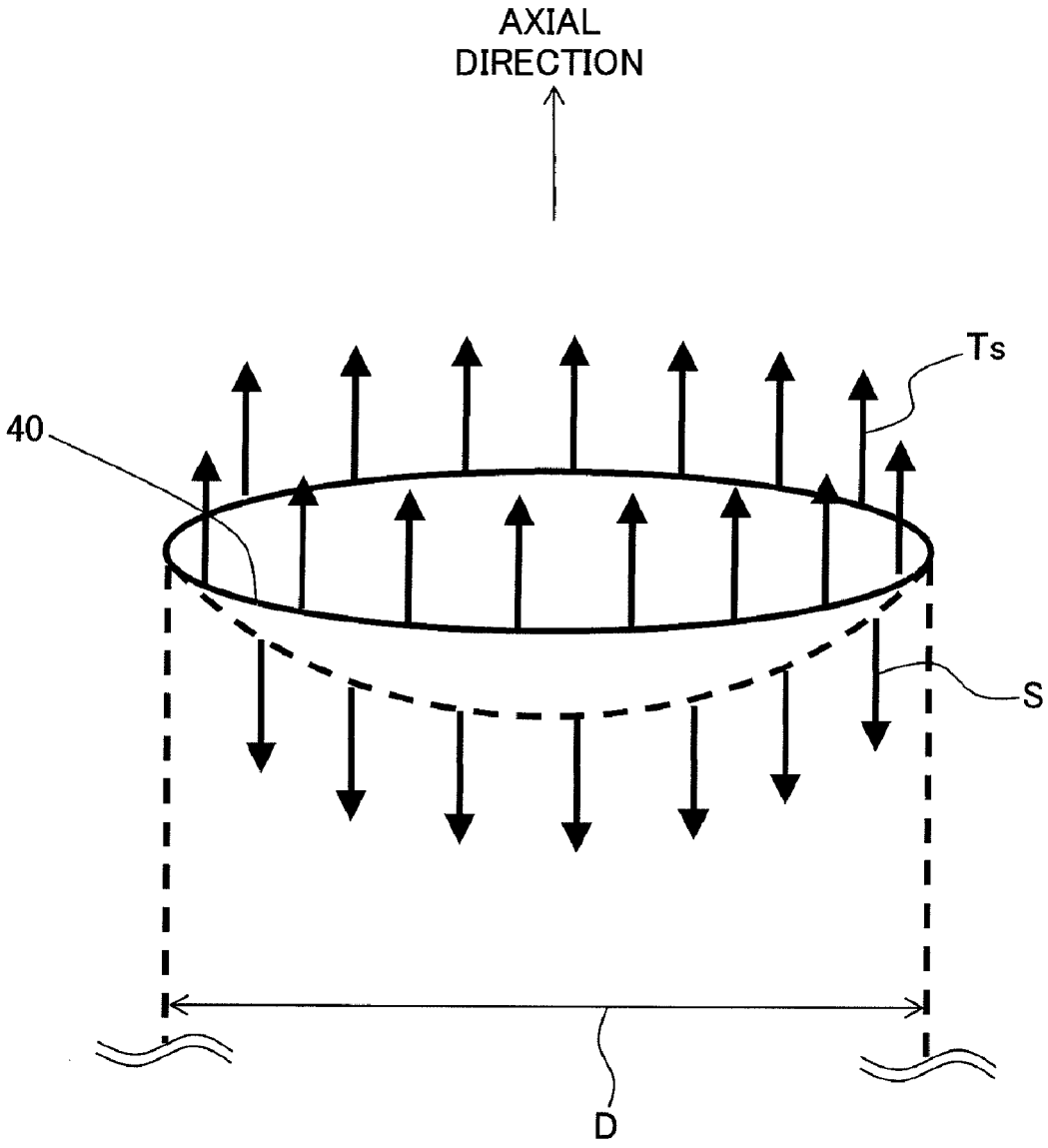
FIG. 8 is a perspective view of a surrounding of the opening of the nozzle.
FIG. 9 is a table showing specifications of the printer according to the first embodiment.

FIG. 7 and FIG. 8 are schematic diagrams in which a surface tension T acting on the nozzle 40 is explained. The meniscus which is formed at an opening of the nozzle 40 has a bilaterally symmetrical shape about a central axis C of the nozzle 40. As shown in FIGS. 7 and 8, the surface tension T acts toward an outer side of the nozzle 40 to have a component in an axial direction of the nozzle 40 along a level of the ink, from a contact point of the ink and a surrounding of the opening of the nozzle 40. In the first modified embodiment, a contact angle between the ink and the nozzle 40 is $\alpha$ (degrees).

Moreover, the surface tension T acting at the opening of the nozzle 40 acts in the axial direction of the nozzle 40 such that the meniscus is maintained, and a surface tension Ts acting at the opening of the nozzle 40 acts in the axial direction. Here, regarding the nozzle 40 having a diameter of D, a generative force Ts in a nozzle axial direction of the meniscus which acts around the nozzle 40, is indicated by the following expression.

$$Ts=T\cos(\alpha)\times D\pi \quad \text{[Eq. 1]}$$

Next, a pressure which acts on the meniscus of the nozzle 40 will be described below. The description is made by citing the ink cartridge 8*d* as a typical example, out of the ink cartridges 8*a* to 8*d* in the first modified embodiment. As shown in FIG. 7, a hydraulic pressure S which acts in a direction of making the meniscus flow back from the nozzle 40 to the ink cartridge 8*d* acts on the meniscus of the nozzle 40 when the ink-jet head 3 is positioned at a position as shown in FIG. 3. Here, the hydraulic pressure exerted due to the water head pressure changes according to the water head difference Hd between the ink cartridge 8*d* and the nozzle 40 of the nozzle row 41. Therefore, when the water head difference between the level of the ink cartridge 8*d* and the nozzle 40 is let to be Hd, the hydraulic pressure S generated due to the water head pressure is expressed by the following expression.

$$S=\rho\cdot Hd\times(d^2\pi/4) \quad \text{[Eq. 2]}$$

Here, in order to maintain the meniscus at the opening of the nozzle 40, the generative pressure Ts of the meniscus is to be higher with respect to the hydraulic pressure S. Accordingly, the meniscus is not broken, and air does not enter from the opening of the nozzle 40. In this manner, a condition for the meniscus of the ink to be maintained at the opening of the nozzle 40 is expressed by the following expression.

$$(T\cos\alpha\times d\cdot\pi)>\rho\cdot Hd\times(d^2\pi/4) \quad \text{[Eq. 3]}$$

Here, in the printer 1 according to the first modified embodiment, the diameter d of the nozzle 40 and a density ρ of the ink are as per specifications shown in FIG. 9. In this case, when the water head difference between the nozzle row 41*d* and the ink cartridge 8*d* is Hd, the printer 1 having the specifications shown in FIG. 9 has a relationship shown by the following expression.

$$T\cos\alpha\times(9.4\times10^{-8})>Hd\times(7.3\times10^{-9}) \quad \text{[Eq. 4]}$$

Here, since the contact angle α is determined according to a material of the nozzle plate 33 and ink, a difference of the contact angle between the nozzle rows is small. Whereas, the water head difference Ha to Hd changes according to the distance between the nozzle rows 41*a* to 41*d* and the ink cartridges 8*a* to 8*d* respectively. Here, as shown in FIG. 6, when the ink-jet head 3 is positioned at the uppermost end, the water head difference Hd between the nozzle row 41*d* and the ink cartridge 8*d* becomes more than the water head difference Ha, Hb, and Hc between the other nozzle rows 41*a* to 41*c* and the ink cartridges 8*a* to 8*c*. Therefore, a substantial hydraulic pressure as compared to the hydraulic pressure on the ink in the nozzles 40 of the other nozzle rows 41*a* to 41*c* is exerted on the nozzles 40 in the nozzle row 41*d*. Due to this hydraulic pressure, the ink flows back toward the ink cartridge 8*d*, and for avoiding the meniscus from breaking by this reverse flow of the ink, it is necessary that the surface tension T has a magnitude which satisfies the equation 4 as mentioned above. Moreover, even for the ink cartridges 8*a* to 8*c*, it is desirable to store an ink for which the surface tension satisfies a relationship indicated by the abovementioned equation 4. For satisfying the abovementioned equation 4, it is desirable to use inks for which the surface tension increases in order from the ink cartridge 8*a* to 8*b*, 8*c*, and 8*d*.

As it has been described above, it is evident that when the surface tension of the ink in the ink cartridge 8*d* for which the water head pressure is maximum becomes substantial, the frequency of occurrence of meniscus break is reduced.

Second Modified Embodiment

In the embodiments and the first modified embodiment described above, examples in which the ink cartridges 8*a* to 8*d* are arranged at the lower side of the main-body case have been described. However, the ink cartridges 8*a* to 8*d* may be arranged at an upper side of the main-body case 2.

Figure 10:
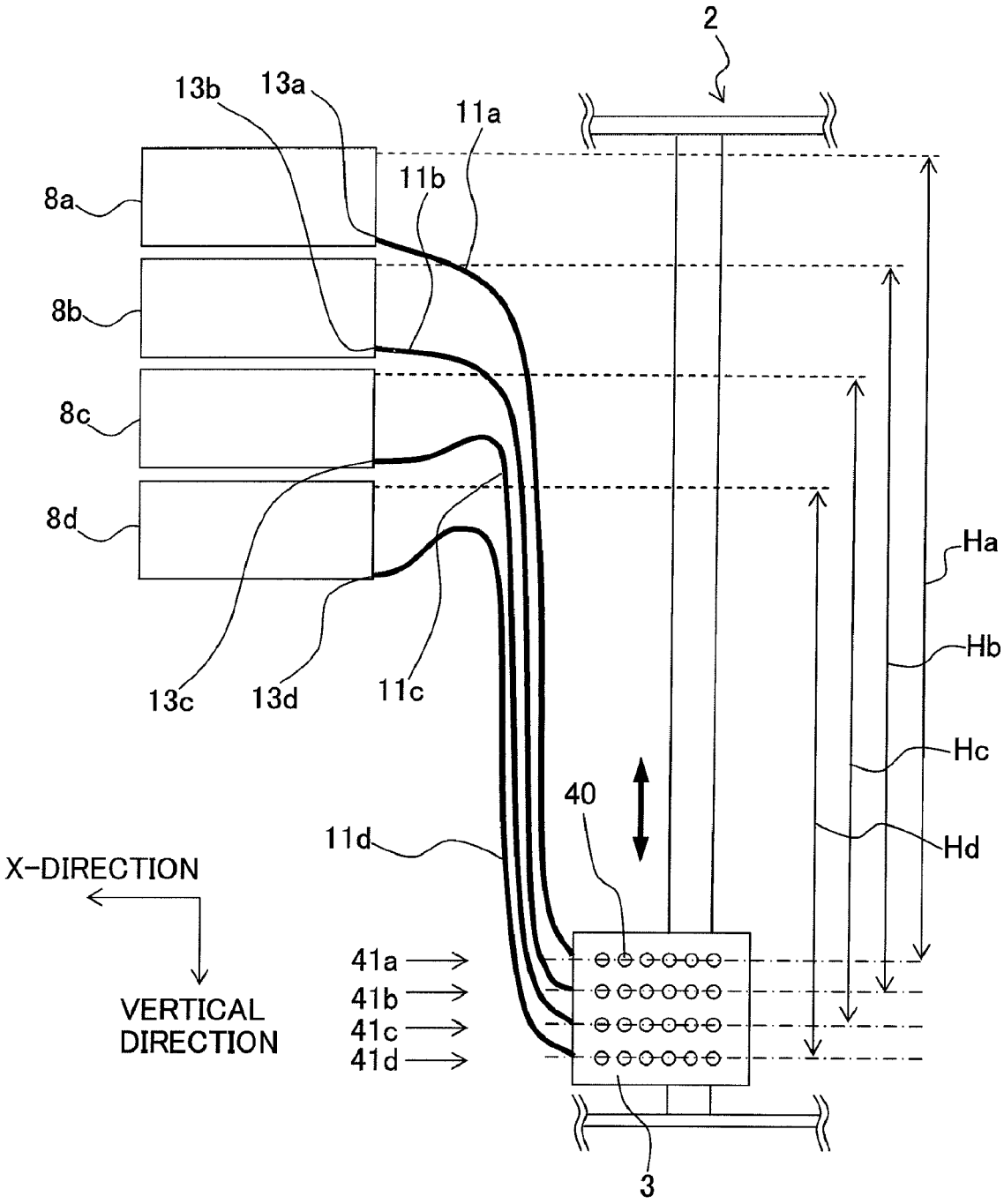
FIG. 10 is a schematic side view of a printer according to a second modified embodiment.

In this case, as shown in FIG. 10, when the ink-jet head 3 has moved to the lowermost end, the ink cartridge 8*a* is at the farthest position from the ink-jet head 3. Therefore, when the ink cartridge 8*a* is connected to the nozzle row 41*a* via the tube 11*a*, it is possible to avoid a situation in which the water head pressure becomes maximum (highest) in a range of movement of the ink-jet head 3. A height of the ink level fluctuates (changes) with the consumption of the ink in the ink cartridge. However, in a structure of a printer shown in FIG. 10, since the water head difference exerted to the nozzle rows becomes the most substantial (maximum) when the ink is filled in the ink cartridge to full capacity (at the time of start of use), Ha, Hb, Hc, and Hd at the time of start of use are shown in FIG. 10.

Moreover, in the printer 1 according to the second modified embodiment, an arrangement is made such that the surface tension of the ink becomes low (decreases) in order of ink cartridges from 8*a* to 8*b*, 8*c*, and 8*d*.

Accordingly, even for the nozzle row 41*a* and the ink cartridge 8*a*, which is a combination in which the water head pressure between the ink-jet head 3 and the ink cartridge 8*a* become maximum, it is possible to reduce the occurrence of meniscus break.

Figure 15:
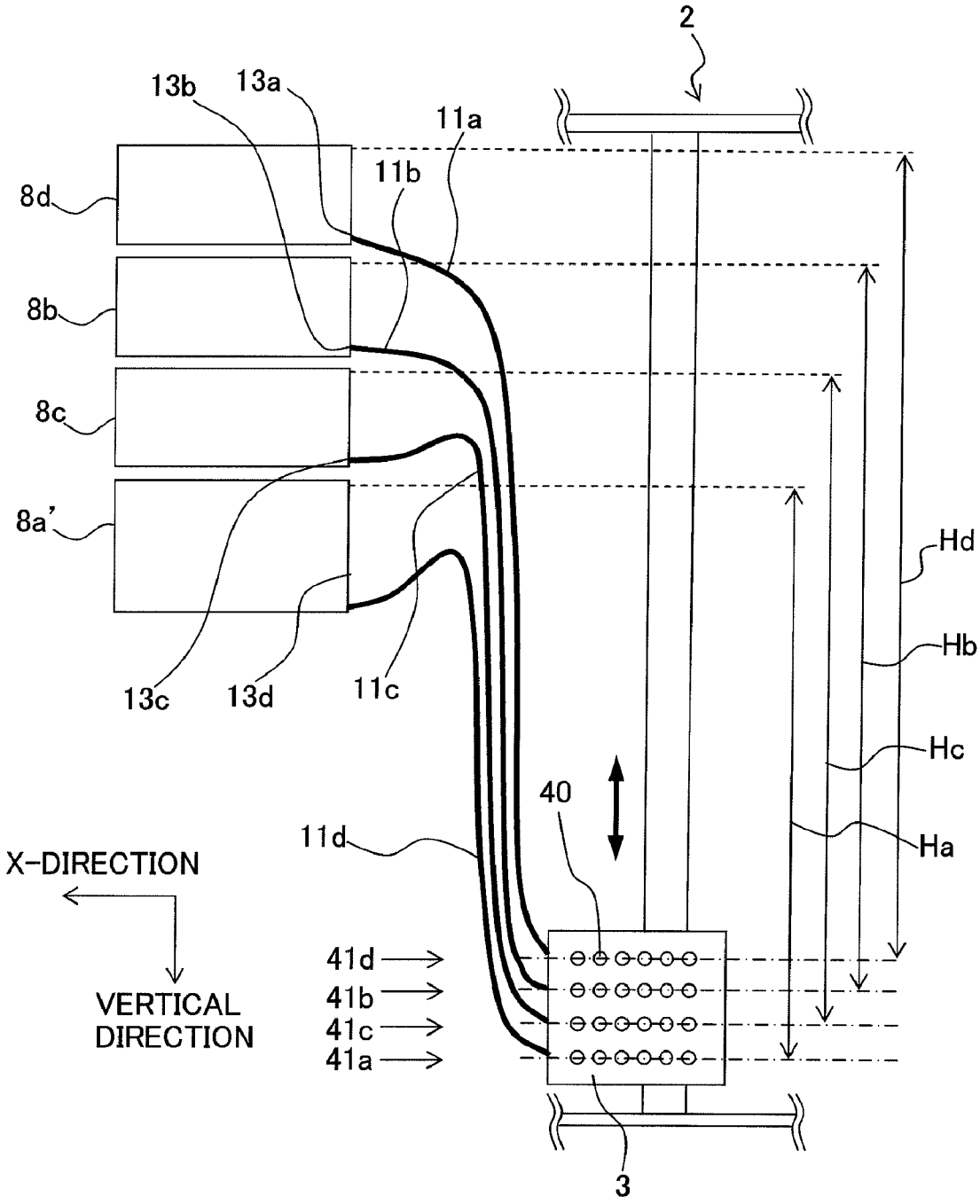
FIG. 15 is a schematic side view of second modified embodiment in which the invention of the second embodiment is introduced.

In a case of applying the invention shown in the second embodiment to the second modified embodiment, it is possible to arrange an ink cartridge 8*a* having a maximum height at a lowest position in the vertical direction as shown in FIG. 15. For the ink cartridge 8*a*' having the maximum height, the fluctuation in the water head difference with the consumption of ink is more than that of the other ink cartridges 8*b*, 8*c*, and 8*d*. However, when the ink cartridge 8*a*' is arranged at the lowermost position, the water head pressure exerted on the nozzle row 41*a* which communicates with the ink cartridge 8*a*' becomes small as compared to the water head pressure of the other nozzle rows 41*b*, 41*c*, and 41*d*. Consequently, it is possible to reduce an effect on the meniscus in the nozzle of the nozzle row 41*a* due to the fluctuation in the water head difference with the consumption of the ink.

In a case of applying the invention shown in the third embodiment to the second modified embodiment, it is possible to make only the tube 11*a* connected to the ink cartridge 8*a* shown in FIG. 10 to be longer than the other tubes 11*b* to 11*d* to be connected to the other ink cartridges 8*b* to 8*d*, and to make the inner diameter of the tube 11*a* to be smaller than the inner diameter of the other tubes 11*b* to 11*d*. In this case, the flow resistance of the ink flowing through the tube 11*a* becomes more (higher) than the flow resistance of the ink flowing through the other tubes 11*b* to 11*d*. Accordingly, even when the water head difference between the nozzle 41*a* and the ink cartridge 8*a* which are connected by the tube 11*a* becomes substantially more according to the position in the vertical direction of the ink-jet head 3, since the flow resistance of the ink flowing from the ink-jet head 3 to the ink cartridge 8*a* is more (higher) than the flow resistance of the ink flowing through the other tubes, a speed of such water head difference being propagated to the nozzle 41*a* becomes slow, and there is no immediate effect of the water head difference on the meniscus of the nozzle in the nozzle row 41*a*.

The case of applying the invention shown in the second embodiment to the second modified embodiment will be described below. In the third embodiment, in the ink-jet head 3 as shown in FIG. 13, the size of the damper 66*d* which communicates with the nozzle 40*d* positioned at the lowest side in the vertical direction is larger than the size of the other dampers 66*a* to 66*c*. In the second modified embodiment, since the maximum water head pressure is exerted on the nozzle 40*a* positioned at the uppermost side in the vertical direction, the diameter of the opening of the damper 66*a* which communicates with the nozzle 40*a* positioned at the uppermost side in the vertical direction is made to be largest (maximum). Accordingly, it is possible to attenuate effectively the pressure wave in the ink which is a change in the water head pressure exerted to the nozzle 40*a*.

Third Modified Embodiment

An arrangement may be made such that a plurality of ink-jet heads according to a third modified embodiment having only one nozzle row unlike the ink-jet head 3 having the plurality of nozzle rows 41*a* to 41*d*, are aligned in the vertical direction and these ink-jet heads are carried by the carriage.

Figure 11:
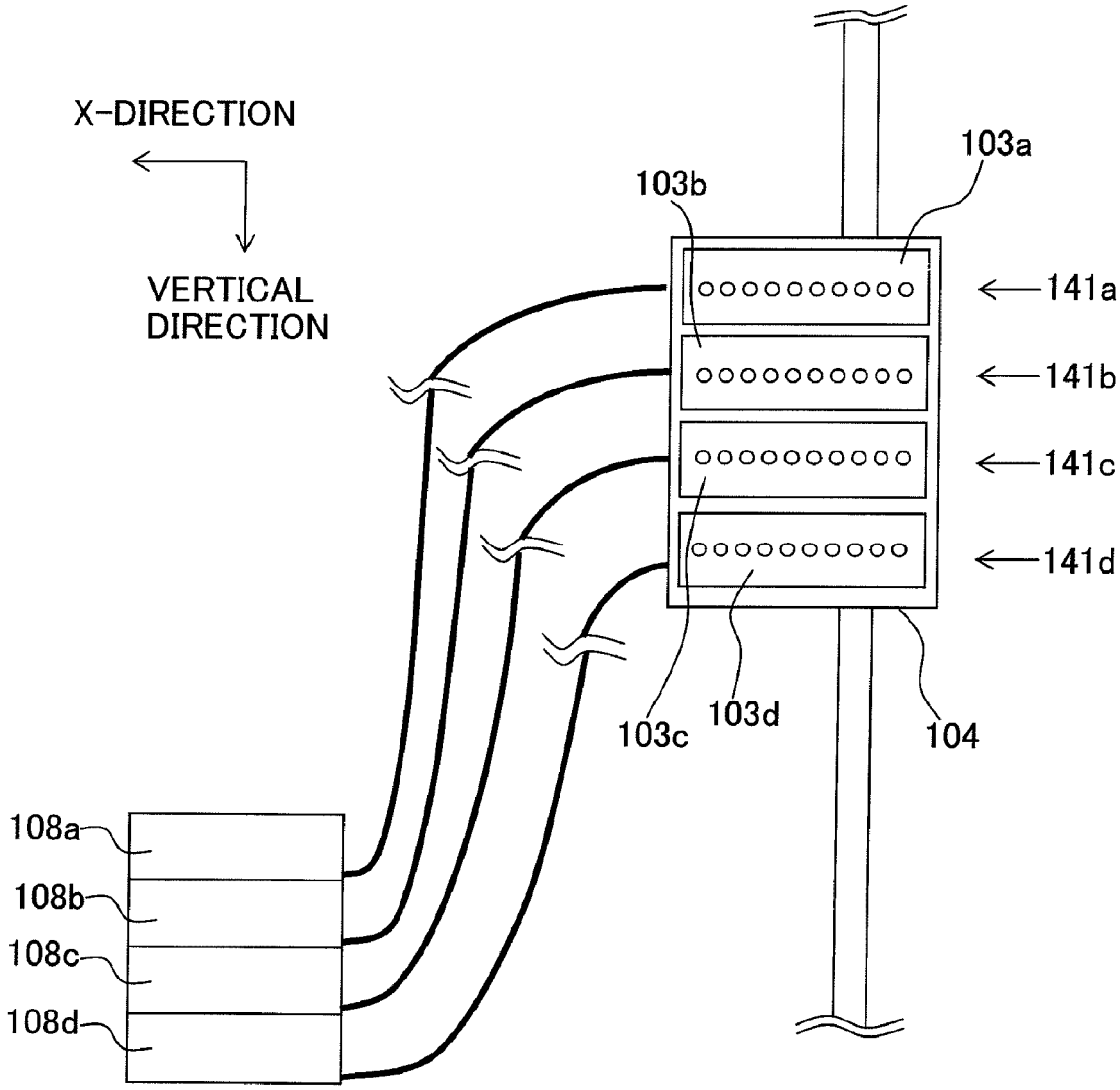
FIG. 11 is a schematic side view of an ink-jet head according to a third modified embodiment.

As shown in FIG. 11, four ink-jet heads 103*a*, 103*b*, 103*c*, and 103*d* have the nozzle rows 141*a*, 141*b*, 141*c*, and 141*d* respectively, and are carried by a carriage 104 upon being aligned thereon in the vertical direction. When the ink-jet heads 103*a* to 103*d* are mounted on the carriage 104 in this manner, the nozzle rows 141*a* to 141*d* are arranged to be mutually parallel. Moreover, the ink-jet head 103*a* and an ink cartridge 108*a* are connected via a tube 111*a* such that the ink is supplied from the ink cartridge 108*a* to the ink-jet head 103*a*. Similarly, the ink-jet heads 103*b* to 103*d* are connected to the ink cartridges 108*b* to 108*d* via tubes 111*b* to 111*d*, respectively. Accordingly, even when the carriage 104 is at the farthest position from the ink cartridges 108*a* to 108*d*, it is possible to avoid a situation in which the water head pressure becomes the maximum. In this manner, it is possible to execute the present invention irrespective of a shape of the ink-jet head. Moreover, the number of ink-jet heads to be mounted on the carriage 2 is not restricted to four, and more than four ink-jet heads may be provided. Furthermore, the number of nozzle rows provided to each ink-jet head is not restricted to one, and a plurality of nozzle rows may be provided in one ink-jet head.

In the printer 1 according to the embodiments, the ink cartridges 8*a* to 8*d* and the nozzle rows 41*a* to 41*d* of the ink-jet head 3 are connected by the tubes 11*a* to 11*d*, to correspond to the same alignment sequence. However, in the printer 1 according to the embodiments and modified embodiments, only the ink cartridge 8*d* and the nozzle 41*d* may be connected by the tube 11*d*, and the other ink cartridges may be connected to an arbitrary nozzle row. Accordingly, even in a case of a positional relationship in which the meniscus break occurs most susceptibly, it is possible to prevent assuredly the meniscus break.

In the embodiments described above, a case in which the interval (distance) P between the nozzle rows 41*a* to 41*d* of the ink-jet head 3 is smaller than the interval (distance) Q between the ink supply ports 11*a* to 11*d* (38*a* to 38*d*) of the ink cartridges 8*a* to 8*d* has been described. However, the present invention is not restricted to such case. It is possible to avoid assuredly a situation in which the water head pressure becomes maximum within the range of movement of the carriage 4, when the ink cartridge, which is located at the farthest position from the ink-jet head 3 when the ink-jet head 3 is positioned at the farthest position with respect to (from) the ink cartridges 8*a* to 8*d*, is connected to the nozzle row at the nearest position from the ink cartridge via the tube, irrespective of the interval P of the nozzle rows 41*a* to 41*d* and the interval Q of the ink cartridges 8*a* to 8*d*.

Moreover, in the embodiments and the modified embodiments described above, the nozzle rows 41*a* to 41*d* are arranged to be mutually parallel in the ink-jet head 3. However, the nozzle rows 41*a* to 41*d* are not necessarily to be arranged in parallel. For example, the nozzle rows 41*a* to 41*d* may be arranged such that one end side of each nozzle row comes near and the other end side goes away, forming a shape of an English alphabet W in X-direction, when viewed from a direction orthogonal to the ink jetting surface. At this time, for the adjacent two nozzle rows, it is necessary that the nozzles 41 in one nozzle row positioned at a lower position in the vertical direction are not arranged at an upper position in the vertical direction than other nozzles 41 in other nozzle rows positioned at a higher position in the vertical direction.

In the embodiments from the first embodiment to the fourth embodiment, and the modified embodiments, various concrete examples of the present invention have been described. However, the present invention is not restricted to the examples described above, and these concrete examples may be combined. For example, ink tubes different from those described in the third embodiment and/or a damper having a damping force different from other dampers as described in the fourth embodiment may be introduced in the printer of the second embodiment. Or, only the ink tube which is different from the other tubes as described in the third embodiment may be introduced in the printer of the fourth embodiment.

In the embodiments and the modified embodiments described above, cases in which inks of four colors and four ink tanks (ink cartridges) are used have been described. However, without restricting to this, inks of more than four colors may be used, and more than five ink tanks may be adopted. A plurality of tanks accommodating ink of the same color may be provided. Accordingly, it is possible to increase the number of ink-jet heads as described above, or all the nozzle rows may be accommodated in a single ink-jet head. Moreover, the present invention is not restricted to an ink-jet printer which carries out printing by jetting an ink, and is also applicable to liquid droplet jetting apparatuses which jets various liquids to adhere onto an object. The liquid to be jetted is not restricted to an ink and may be various materials such as medicines, chemical substances (chemicals), and beverages.

What is claimed is:

1. A liquid jetting apparatus which jets a plural kinds of liquids, comprising:

a liquid jetting head having a plurality of nozzle rows formed therein, through which the plural kinds of liquids are jetted, respectively;

a plurality of liquid tanks arranged in a vertical direction, the liquid tanks accommodating the plural kinds of liquids, respectively, to be supplied to the liquid jetting head;

a plurality of tubes which are connected to the liquid jetting head and the liquid tanks such that the nozzle rows are communicated with the liquid tanks, respectively; and a carriage which reciprocates in a predetermined range in the vertical direction while holding the liquid jetting head, wherein when the carriage is located farthest from the liquid tanks within the predetermined range, a farthest liquid tank among the liquid tanks which is located farthest from the carriage is connected to a nearest nozzle row among the nozzle rows which is located nearest from the tanks, via one tube among the tubes; and wherein a liquid-flow resistance in the one tube is higher than that of the other tubes of the plurality of tubes.

2. The liquid jetting apparatus according to claim 1, wherein the one tube is longer than the other tubes.

3. The liquid jetting apparatus according to claim 1, wherein an inner diameter of the one tube is smaller than that of the other tubes.

4. The liquid jetting apparatus according to claim 1, wherein when the carriage is located farthest from the plurality of liquid tanks within the predetermined range, a thickness in the vertical direction of a nearest liquid tank among the liquid tanks which is located nearest from the carriage is greater than a thickness in the vertical direction of the farthest liquid tank.

5. The liquid jetting apparatus according to claim 4, wherein the nearest liquid tank accommodates a black ink.

6. The liquid jetting apparatus according to claim 1, further comprising buffer tanks which are connected to the nozzle rows, respectively, a part of each of the buffer tanks being formed as a damper, wherein when the carriage is located farthest from the liquid tanks within the predetermined range, a damping force of the damper, of one buffer tank among the buffer tanks which is connected to the nearest nozzle row, is greater than that of the damper of each of other buffer tanks connected to other nozzle rows.

7. The liquid jetting apparatus according to claim 6, wherein a size of the damper of the one tank is larger than that of the damper of each of the buffer tanks.

8. The liquid jetting apparatus according to claim 1, wherein the predetermined range in which the carriage reciprocates in the vertical direction is shifted upwardly from an installation position of the liquid tanks, and a lowermost liquid tank among the liquid tanks positioned at a lower end in the vertical direction is connected to a lowermost nozzle row among the nozzle rows positioned at a lower end in the vertical direction via one of the tubes, and wherein a surface tension of a liquid, among the plural kinds of liquids, accommodated in the lowermost liquid tank is higher than that of another liquid accommodated in another liquid tank among the liquid tanks.

9. The liquid jetting apparatus according to claim 1, wherein the predetermined range in which the carriage reciprocates in the vertical direction is shifted downwardly from an installation position of the liquid tanks, and an uppermost liquid tank, among the liquid tanks, positioned at an upper end in the vertical direction is connected to an uppermost nozzle row, among the nozzle rows, positioned at an upper end in the vertical direction via one of the tubes.

10. The liquid jetting apparatus according to claim 9, wherein a surface tension of a liquid, among the plural kinds of liquids, accommodated in the uppermost liquid tank is higher than that of another liquid accommodated in another liquid tank among the liquid tanks.

11. The liquid jetting apparatus according to claim 1, wherein an order by which the liquid tanks are arranged in the vertical direction, and an order by which the nozzle rows are arranged in the vertical direction are same with respect to the kinds of liquids, and the plurality of tubes connects the nozzle rows and the liquid tanks, respectively, with respect to the kinds of liquids.

12. The liquid jetting apparatus according to claim 11, wherein a water head pressure exerted to a lowermost nozzle row among the nozzle rows arranged at lowest end in the vertical direction is higher than that exerted to an uppermost nozzle row arranged at uppermost end in the vertical direction.

13. The liquid jetting apparatus according to claim 1, wherein each of the nozzle rows is extended in a horizontal direction.

14. The liquid jetting apparatus according to claim 1, wherein the liquid jetting head has a plurality of heads, each having the plurality of nozzle rows formed therein.

15. The liquid jetting apparatus according to claim 1, wherein the liquid jetting apparatus is an ink-jet printer which includes a paper feeding roller having a rotating shaft extended in the vertical direction.

16. The liquid jetting apparatus according to claim 8, wherein each of nozzle rows is extended in a horizontal direction.

17. The liquid jetting apparatus according to claim 8, wherein the liquid jetting head has a plurality of heads, each having the plurality of nozzle rows formed therein.

18. The liquid jetting apparatus according to claim 8, wherein the liquid jetting apparatus is an ink-jet printer which includes a paper feeding roller having a rotating shaft extended in the vertical direction.

* * * * *